US011858592B2

(12) United States Patent
Renaud et al.

(10) Patent No.: US 11,858,592 B2
(45) Date of Patent: Jan. 2, 2024

(54) ENCLOSURE SYSTEM FOR A PONTOON BOAT

(71) Applicant: Polaris Industries Inc., Medina, MN (US)

(72) Inventors: Benoit J. Renaud, Elkhart, IN (US); Brian M. Rupp, Goshen, IN (US); Walter B. Ross, Middlebury, IN (US)

(73) Assignee: Polaris Industries Inc., Medina, MN (US)

( * ) Notice: Subject to any disclaimer, the term of this patent is extended or adjusted under 35 U.S.C. 154(b) by 105 days.

(21) Appl. No.: 17/475,621

(22) Filed: Sep. 15, 2021

(65) Prior Publication Data

US 2022/0081070 A1 Mar. 17, 2022

Related U.S. Application Data

(60) Provisional application No. 63/079,756, filed on Sep. 17, 2020.

(51) Int. Cl.
*B63B 17/04* (2006.01)
*B63B 1/02* (2006.01)

(52) U.S. Cl.
CPC ..... *B63B 17/04* (2013.01); *B63B 1/02* (2013.01)

(58) Field of Classification Search
CPC . B63B 2017/0045; B63B 17/02; B63B 17/04; B63B 1/02; F16M 13/022
USPC ..... 114/364
See application file for complete search history.

(56) References Cited

U.S. PATENT DOCUMENTS

| | | | | |
|---|---|---|---|---|
| 6,588,361 | B2 * | 7/2003 | Biedenweg | B63B 17/02 114/361 |
| 7,222,582 | B1 * | 5/2007 | Whiting | B62J 9/26 114/364 |
| 7,484,472 | B1 * | 2/2009 | Highfield | B63B 17/02 114/361 |
| 8,359,994 | B1 * | 1/2013 | Highfield | B63B 19/18 114/361 |
| D764,380 | S | 8/2016 | Conrad | |
| 10,724,679 | B2 * | 7/2020 | Parniske | F16M 13/022 |
| 2007/0022938 | A1 | 2/2007 | Fishburn | |
| 2011/0164408 | A1 | 7/2011 | Bol | |

* cited by examiner

*Primary Examiner* — Daniel V Venne
(74) *Attorney, Agent, or Firm* — Christensen, Fonder, Dardi & Herbert PLLC

(57) ABSTRACT

A rail system for a pontoon boat is provided. The rail system allows for the addition and removal of a pontoon boat skin, as well as additional features and attachments without dismantling the rail system. The system may include detachable rail caps and/or rail attachments that hold the skin against the rail. The rails also include features to attach exterior attachments such as accents, bumpers, and inserts.

20 Claims, 22 Drawing Sheets

ENCLOSURE SYSTEM FOR A PONTOON BOAT

RELATED APPLICATION

This application claims the benefit of U.S. Provisional Application No. 63/079,756, filed Sep. 17, 2021, titled ENCLOSURE SYSTEM FOR A PONTOON BOAT, the entire disclosure of which is expressly incorporated by reference herein.

FIELD

The present disclosure relates to systems and methods for above deck boat enclosure systems for a pontoon boat and, more particularly, to an enclosure skeletal system and accompanying skin for a pontoon boat.

BACKGROUND

Pontoon boats often have an enclosure system supported by the deck that serves as a boundary of a passenger compartment of the pontoon boat. Traditional enclosure systems include a skeletal system including rails to which skins are attached by deforming an extension portion of the rails to crimp the skin to the rails. The skin can be slid along the rails, and crimping features on the rails are bent down to hold the skin against the rails. Adhesives, staples, or rivets are also often used to keep the skin in place. However, if the skin becomes damaged or the boat owner wants to replace the skin, the process often involves removing and replacing the rails as well since they have undergone deformation to retain the skin.

SUMMARY

In an exemplary embodiment of the present disclosure, an enclosure system for a pontoon boat comprises a skeletal system comprising a plurality of rails including an upper rail having an interior void and a first wall including an opening therethrough to the interior void; a skin positioned against a first side of the upper rail; and a rail coupler extending along the upper rail, the rail coupler including a protrusion which is received through the opening in the first wall of the upper rail into the interior void of the upper rail to secure the rail coupler to the upper rail and an interface portion, the skin being captured between the interface portion of the rail coupler and the first side of the upper rail, the rail coupler coupling the skin to the skeletal system.

In an example thereof the rail coupler is removably coupled to the skeletal frame. In a further example thereof, the first wall is on the first side of the upper rail. In a still further example thereof, the first wall is on a second side of the upper rail. In yet a further example, the first side is vertically oriented and the second side is horizontally oriented. In still yet a further example thereof, the rail coupler is a rail cap which overlaps multiple exterior sides of the upper rail including the first side. In a variation thereof, the rail cap includes an attachment feature to receive an accessory to couple the accessory to the upper rail. In a further example thereof, the rail cap is made of a flexible material.

In another exemplary embodiment of the present disclosure, an enclosure system for a pontoon boat comprises a skeletal system comprising a plurality of rails including an upper rail; a skin positioned against a first side of the upper rail; and a rail coupler extending along the first side of the upper rail, a second side of the upper rail opposite the first side, and a third side of the upper rail, the third side being between the first side and the second side, the skin being captured between an interface portion of the rail coupler and the first side of the upper rail, the rail coupler coupling the skin to the skeletal system.

In an example thereof, the rail coupler is removably coupled to the skeletal frame. In another example thereof, the rail coupler includes a first interactive member which cooperates with a first external coupling feature of the upper rail and a second interactive member which cooperates with a second external coupling feature of the upper rail. In a variation thereof, the first interactive member is a first protrusion and the first external coupling feature of the upper rail is a first recess to receive the first protrusion and the second interactive member is a second protrusion and the second external coupling feature of the upper rail is a second recess to receive the second protrusion. In still a further example thereof, the upper rail has a first width and the rail coupler includes a first leg and a second leg spaced apart from the first leg and a connecting portion, the first leg, the second leg, and the connecting portion defining a void wherein the upper rail is positioned, the first leg and the send leg having a separation prior to receiving the upper rail, the separation of the first leg and the second leg being less than the first width of the upper rail. In yet a further example thereof, the rail coupler is made of a flexible material.

In another exemplary embodiment of the present disclosure, a method for adding a skin onto a pontoon boat comprises the steps of providing a skeletal frame including an upper rail supported by a deck of the pontoon boat; placing the skin against an outer surface of the upper rail; and attaching a rail cap onto the rail such that the rail cap presses the skin against the rail, thereby securing the skin to the upper rail.

In yet another exemplary embodiment of the present disclosure, a method for replacing a skin on a pontoon boat comprises the steps of moving a rail cap relative to an upper rail of a skeletal frame of the pontoon boat from a first position to a second position, wherein in the first position the rail cap holds the skin relative to the upper rail of the skeletal frame; removing the skin from a position against the upper rail; positioning a new skin along the upper rail; and moving the rail cap back to the first position to hold the new skin relative to the upper rail of the skeletal frame. In an example thereof, the second position is completely spaced apart from the upper rail of the skeletal frame.

In still yet another exemplary embodiment of the present disclosure, a method for replacing a skin on a pontoon boat comprises the steps of removing a rail cap relative to an upper rail of a skeletal frame of the pontoon boat from a first position to a second position, wherein in the first position the rail cap holds the skin relative to the upper rail of the skeletal frame; removing the skin from a position against the upper rail; positioning a new skin along the upper rail of the skeletal frame; and positioning a new rail cap relative to the upper rail to hold the skin relative to the upper rail of the skeletal frame.

In yet another exemplary embodiment of the present disclosure, an enclosure system for a pontoon boat comprises: a frame coupled to a deck of the pontoon boat comprising a number of rails; an illumination source coupled to at least one of the number of rails; and a rail coupler coupled to the at least one of the number of rails and extending over the illumination source, the rail coupler comprising a transparent portion configured to allow a light from the illumination source to pass through the rail coupler. In an example thereof, the enclosure system further comprises a skin positioned at least partially between the rail coupler and the at least one of the number of rails.

BRIEF DESCRIPTION OF THE DRAWINGS

The above-mentioned and other features and advantages of this disclosure, and the manner of attaining them, will become more apparent and will be better understood by reference to the following description of exemplary embodiments taken in conjunction with the accompanying drawings, wherein.

Corresponding reference characters indicate corresponding parts throughout the several views. The exemplification set out herein illustrates an exemplary embodiment of the invention and such exemplification is not to be construed as limiting the scope of the invention in any manner.

DETAILED DESCRIPTION OF THE DRAWINGS

Figure 1:
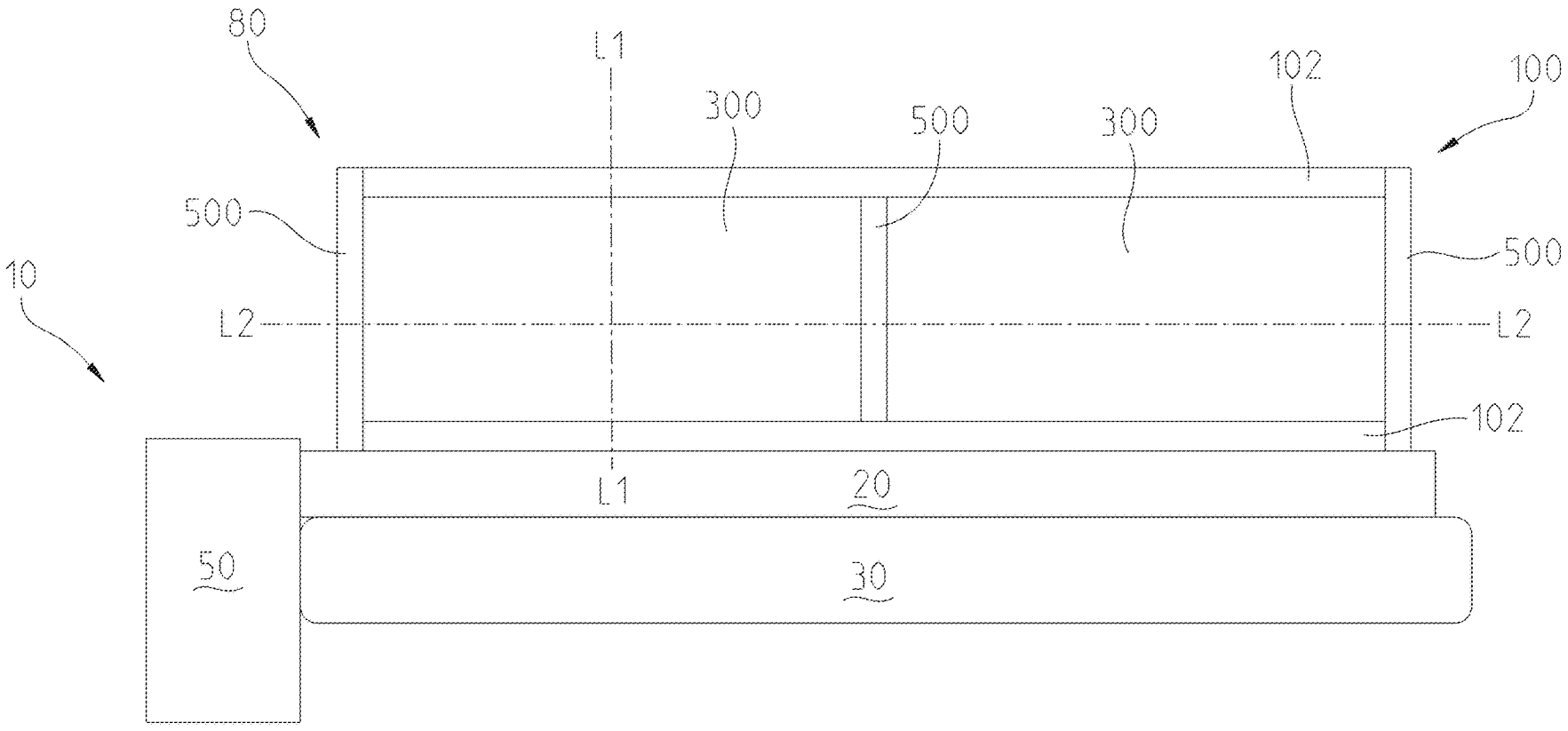
FIG. 1 illustrates a simplified pontoon boat with an exemplary enclosure system of the present disclosure.

For the purposes of promoting an understanding of the principles of the present disclosure, reference is now made to the embodiments illustrated in the drawings, which are described below. The embodiments disclosed herein are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. Corresponding reference characters indicate corresponding parts throughout the several views.

The terms "couples", "coupled", "coupler" and variations thereof are used to include both arrangements wherein the two or more components are in direct physical contact and arrangements wherein the two or more components are not in direct contact with each other (e.g., the components are "coupled" via at least a third component), but yet still cooperate or interact with each other.

In some instances throughout this disclosure and in the claims, numeric terminology, such as first, second, third, and fourth, is used in reference to various components or features. Such use is not intended to denote an ordering of the components or features. Rather, numeric terminology is used to assist the reader in identifying the component or features being referenced and should not be narrowly interpreted as providing a specific order of components or features.

Referring first to FIG. 1, a pontoon boat 10 is shown. Pontoon boat 10 comprises a driving system 50 (e.g. a motor), a number of pontoons 30, a deck 20 coupled to the pontoons 30, and an enclosure system 80 coupled to the deck 20. The enclosure system 80 generally defines an exterior and interior to the boat 10, wherein the enclosure system 80 encloses a space on the boat 10 for users to position themselves. The boat interior formed by the enclosure system 80 may comprise seating, driving mechanisms, tables, flooring, storage space, or any other boat features as are known in the art.

Figure 3:
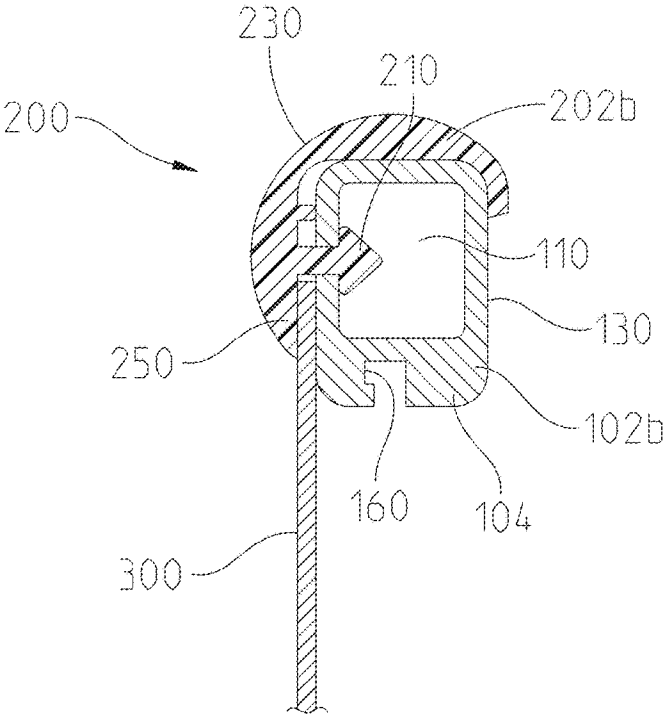
FIG. 3 illustrates a sectional view of another upper rail and associated rail cap.
Figure 2:
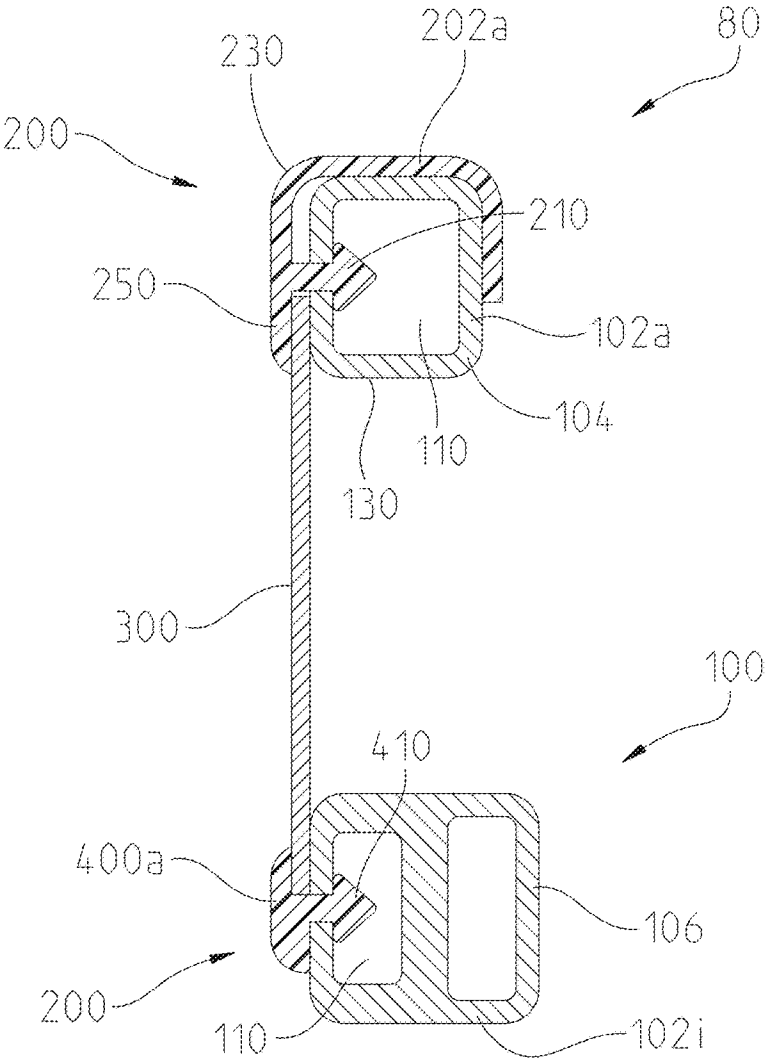
FIG. 2 illustrates a sectional view along L1 in FIG. 1 of an upper rail and lower rail of a skeletal frame of a pontoon boat having a skin spanning therebetween and secured with a plurality of rail couplers including a first rail cap and a first rail attachment.

Referring to FIGS. 1-3, the enclosure system 80 comprises a rail system 100, and a skin 300. The rail system 100 generally defines a frame or skeleton for the enclosure system 80 around the boat 10, and accordingly may also be referred to as a frame or skeletal system. In other embodiments, the enclosure system 80 and/or rail system 100 may only enclose a portion of the boat 10, and may also be positioned within the interior of the boat 10. For example, the bow and stern of the boat 10 may have fiberglass body panels while the port and starboard sides of the boat 10 may have the rail system. When positioned in the interior, the enclosure system 80 or rail system 100 may divide the boat into separate sections or provide additional partitions within boat 10. Rail system 100 is not limited to standard "rails" as is known in the art, but may comprise any materials or structural elements to provide a framework to the enclosure system 80. The rail system 100 comprises a number of rails 102, a number of support rails 500, and a number of rail couplers 200. Rail couplers 200 may be rail caps 202, rail attachments 400, or any other features or devices that may couple to rail system 100. Rail couplers 200 may also be described as rail or exterior features, or rail or exterior connectors. Rails 102 form the framework of rail system 100 and provide a primary structure for enclosing the boat 10. Rails 102 may be an upper rail 104, a middle rail 105 (see FIG. 13), a lower rail 106, or a support rail 500. The support rails 500 or lower rails 102 provide structural support to rail system 100 and may couple components of rail system 100 to one another. Skin 300 extends generally between two rails 102 and forms a wall around or within the boat 10. In embodiments, the enclosure includes multiple skin pieces which collectively form a wall around or within the boat 10. As shown in FIG. 2, skin 300 may extend between an upper rail 104 and a lower rail 106. Rails 102 may comprise a single rail extending around the boat 10, or of multiple pieces coupled together through welds, adhesives, rivets, staples, or any other suitable coupling devices. As shown in FIG. 1, rails 102 are generally horizontal and run approximately parallel to the deck 20 of the boat 10, but in other embodiments rails 102 may extend in any direction and may be formed into any shape. For example, rails 102 may curve towards or away from the deck 20 to form a more stylized rail system 100. Rails 102 may made from metals, polymers, wood, composites, or any other material to provide desired structural properties for rail system 100. In an exemplary embodiment, rails 102 are formed from an aluminum extrusion.

In an exemplary embodiment, rails 102 are coupled to the boat 10 through support rails 500. In other embodiments, rails 102 may be coupled directly to boat 10 (for example, the lower rail 102 in FIG. 1). Support rails 500 provide structural support to rail system 100 and may couple any number of support rails 102 together. Support rails 500 may be coupled to rails 102, deck 20, skin 300, or other support rails 500 through welds, adhesives, friction, rivets, screws, staples or any other devices configured to couple with support rails 500. Rails 102 (including support rails 500) may also be coupled to deck 20 through deck fasteners 450 as described further below. Support rails 500 may be generally vertically oriented and may extend generally perpendicular to the deck 20 of boat 10, yet in other embodiments, support rails 500 may extend in any direction and have any shape. For example, support rails 500 may curve or bend throughout the rail system 100 and may be angled relative to deck 20. Support rails 500 may be altered in shape or orientation to provide additional support or add stylized features or designs to rail system 100.

In the illustrated embodiment, rails 102 comprise an exterior 130 and an interior 110. In other embodiments, rails 102 may be a solid piece without an open interior 110. Furthermore, the rails 102 as illustrated are generally rectangular in shape, but in other embodiments may have any shape cross-section. Rail exterior 130 may comprise texture or features such as grooves, bumps, ridges, or any other surface features. Such surface features on the rail exterior 130 may provide a surface that is more appealing for users to interact with, and may also provide additional grip or adhesion to other components of rail system 100. Furthermore, rail exterior 130 may be coated with various materials to provide additional adhesion, weather/damage resistance, or improved tactile features. Rails 102 may also comprise a number of coupling features 160 (See FIG. 3). Coupling features 160 may be used to couple a variety of attachments to rails 102, including canopies, canvases, colored accents, bumpers, rubber inserts, or other attachments as are known in the art. Further, as described herein, rails 102 may include one or more exterior pockets which receive accent pieces or accessories.

Referring to FIGS. 2-3 the rail couplers 200 of the rail system 100 include a number of rail caps 202, which may also be referred to simply as caps 202, and a number of rail attachments 400. In the illustrated embodiment, caps 202 comprise a cap exterior 230, interface portion 250, and at least one interactive member 210. Caps 202 are generally configured to extend around three sides of rails 102 and to couple to rails 102. In the illustrated embodiments, caps 202*a* couple to rails 102*a* through interactive member 210. Interactive member 210 may be any feature that allows caps 202 to be coupled to rails 102. As illustrated in exemplary caps 202*a*, 202*b*, and 202*c*, interactive member 210 may be a protrusion that extends from cap 202 into the interior 110 of rail 102. As shown, the protrusion has a flange-like portion that retains the interactive member 210 within interior 110. The interactive member 210 may be configured to be flexible or deformable such that the interactive member 210 may be pushed/squeezed into the interior 110 of rails 102 through an opening in rails 102, wherein the opening within rails 102 is generally smaller than the resting state of the interactive member 210. Accordingly, the interactive member 210 may expand to a resting state upon passing through the opening to secure the cap 202 to the rail 102. The interactive member 210 may be inserted into rails 102 through a hole, bore, or opening in the rail 102, or may be slid into interior 110 starting from an end of rail 102 and slid along the length of rail 102. Interactive members 210 may be continuous along the entire length of the cap 202, or may be discrete elements located at various points along the cap 202. Furthermore, interactive members 210 may interact with any side of the rail 102, and may interact with more than one side in a given embodiment.

The interface portion 250 of cap 202 is configured to interface, couple, or otherwise engage with the skin 300 and to couple the skin 300 to rail 102 when the caps 202 are coupled to rails 102. Interface portion 250 may comprise surface features such as bumps, ridges, or other textures to provide additional grip to skin 300. In an exemplary embodiment, the interface portion 250 of cap 202 is pressed against the skin 300 by a force caused by the interactive member 210 being retained within rail 102. Furthermore in the exemplary embodiment, interactive members 210 do not extend through skin 300, and only the interface portion 250 of the caps 202 couple the skin 300 to the rails 102. This configuration allows for the skin 300 to be moved by simply removing the caps 202 from the rail system 100. In other embodiments, interactive member 210 may pass through skin 300 to further secure skin 300 to rails 102.

In an exemplary embodiment, the caps 202 are composed of an elastomer and may be snapped, stretched, or pulled over/around rails 102 to couple the caps 202 to the rails 102. Further in the exemplary embodiment, the caps 202 are made of a resilient material, such that the force caused by retention of interactive member 210 within rail 102 causes the cap 202 to bend slightly, and the resiliency of the cap 202 material causes a pressure on skin 300 when the skin 300 is positioned between the cap 202 and the rail 102. In an exemplary embodiment, the caps 202 are formed as a polymer extrusion. In other embodiments, caps 202 are formed as a coextrusion with other polymers or materials to provide additional features on caps 202. Caps 202 may be made of a metal, polymer, composite, wood, or any other suitable material. In the instances where the caps 202 are not generally flexible, the caps 202 may be slid into rails 102 or may feature a joint and/or a locking mechanism to secure the caps 202 to the rails 102. In other embodiments, caps 202 may comprise a hinge or a living hinge (not shown) which may allow caps 202 to be bent or otherwise moved relative to the rails 102 in order to engage or disengage with skin 300. In embodiments where the rails 102 are not generally rectangular in shape, caps 202 may be configured to match the shape of rails 102.

The surface 230 of rail couplers 200 may comprise various shapes, textures, colors, or features. As illustrated in FIG. 3, the surface 230 of rail cap 202*b* is generally rounded in shape, and may function as a bumper or may provide a user with a more comfortable grip on cap 202*b*. Cap 202*b* is configured to couple with rail 102*b*. The surface 230 of rail couplers 200 may be coated with material, such as paint or protective coatings, in order to achieve the desired surface features, or the rail couplers 200 themselves may be formed with varied surfaces 230, for example with a coextrusion process. For example, a multi-color rail coupler 200 may be produced with a coextrusion process. Furthermore, rail couplers 200 may be shaped and textured to meet grab rail compliance requirements (e.g. having a minimum/maximum diameter).

Rail couplers 200 may also be embodied as rail attachments 400. Rail attachments 400 may differ from caps 202 in that rail attachments 400 may not generally extend around at least three sides of rails 102, but may extend around multiple sides of rails 102. As shown in FIG. 2, rail attachments 400 may be used to couple skin 300 to a rail 102 in situations where a cap 202 may not be easily slid around rail 102 (e.g. instances where rail 102 is coupled directly to the deck 20). Skin 300 may be coupled to rail 102 through an interfacing portion of rail attachment 400 in a similar way to cap 202, or the skin may be otherwise attached to rail attachment 400. Rail attachment 400*a* comprises an interactive member 410 configured to interact with the rail 102 to couple rail attachment 400 to rail 102. In the illustrated example, the interactive member 410 is a protrusion that extends into an interior 110 of the rail 102, similar to the interactive member 210 of cap 202.

In an exemplary embodiment, the skin 300 is composed of sheet metal, and may also comprise coatings, paint, decals, other layers of material, or other surface features. In other embodiments, the skin may be composed of any material suitable to make a wall for the pontoon boat 10, including polymers, metals, composites, glass, or wood. In the event that any portion of the skin should be replaced, the rail couplers 200 may be removed from the rails 102 or otherwise moved relative to rails 102, which releases the skin 300. A new skin 300 may then be positioned against the rails 102, and the rail couplers 200 may be coupled onto rails 102, thereby coupling the skin 300 to the rails 102. In this way, the skin 300 may be added, removed, or replaced without having any impact on the rails 102. In other embodiments, an adhesive or a tape may be applied between the skin 300 and the rails 102 and/or the rail couplers 200. For example, double-sided tape may be positioned on the rails 102 or rail couplers 200 before positioning the skin 300 against the rails 102. The tape/adhesive may be configured to provide additional grip or thickness to reduce vibration of the skin 300 when the boat 10 is in use.

As illustrated in FIG. 2, the skin 300 extends generally between two rails 102, illustrated as an upper rail 104 and a lower rail 106. In further illustrated embodiments of rail system 100 where only one rail 102 is depicted, it should be understood that the skin 300 may still extend between two or more rails 102. Any combination of disclosed embodiments of rails 102, or variations thereof, may be used within rail system 100 as upper rails 104, lower rails 106, middle rails 105, support rails 500, or any a rail in any other position within the frame. Furthermore, any disclosed embodiments of support rails 500 may be used as rails 102. Any features illustrated or otherwise disclosed as being part of an upper rail 104, lower rail 106, middle rail 105, or support rail 500 may also be included on any other type of rail in rail system 100.

Figure 4:
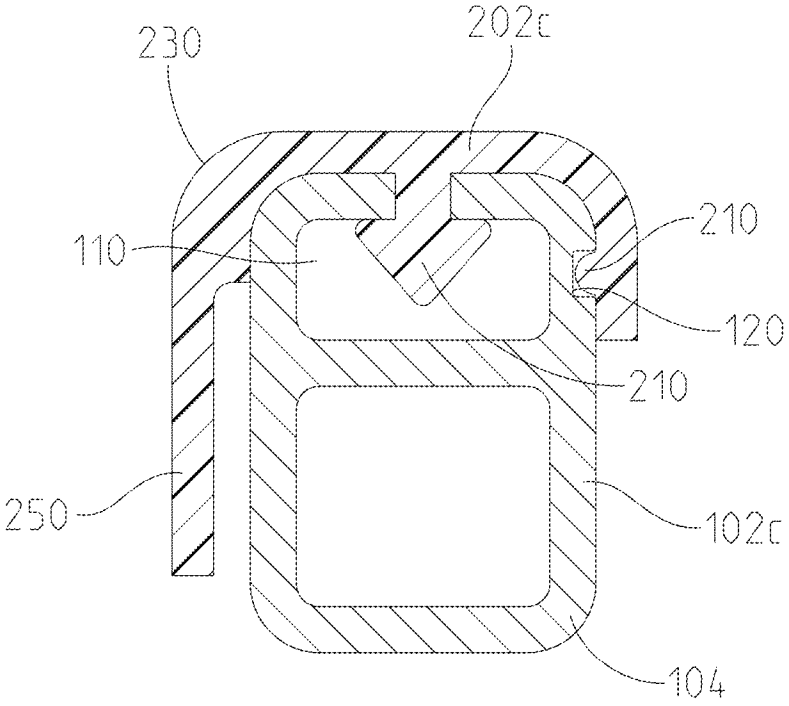
FIG. 4 illustrates a sectional view of a further upper rail and associated rail cap.

Referring to FIG. 4, the interactive member 210 of cap 202 may include a protrusion, configured to couple the cap 202 to the rail 102 through an exterior coupling instead of being received in the interior of the rail 102. The rail 102 may comprise an external coupling feature 120 to interact with interactive member 210. In the illustrated embodiment, cap 202*c* comprises two interactive members 210, an interior protrusion configured to couple to rail 102 by entering the interior 110 of rail 102*c*, as well as an exterior protrusion configured to couple to rail 102*c* by interfacing with an exterior coupling feature 120. The interactive members 210 may also be described as cap coupling features, as they may assist in coupling cap 202 to rail 102. Similarly, interior features (the walls of interior 110), exterior coupling features 120, and pocket 180 (described below) may be described as rail coupling features, as they may also assist in coupling the cap 202 to the rail 102. In other embodiments, cap coupling features and rail coupling features may be any compatible systems for coupling the cap 202 to the rail 102. Examples of coupling features include snaps, buttons, zippers, locks, detents, joints, adhesives, staples, or other common coupling devices as are known in the art. In another example, the rail 102 may comprise protrusions and the cap 202 may comprise recesses to receive protrusions.

Figure 6:
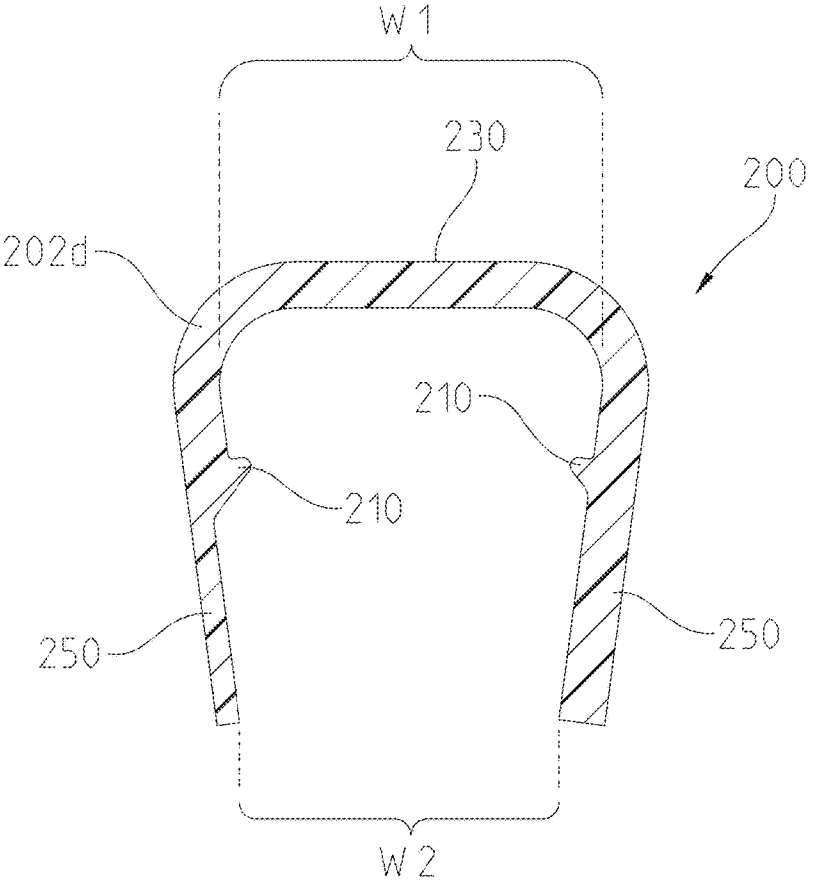
FIG. 6 illustrates a sectional view of the associated rail cap of FIG. 5 removed from the upper rail of FIG. 5.
Figure 5:
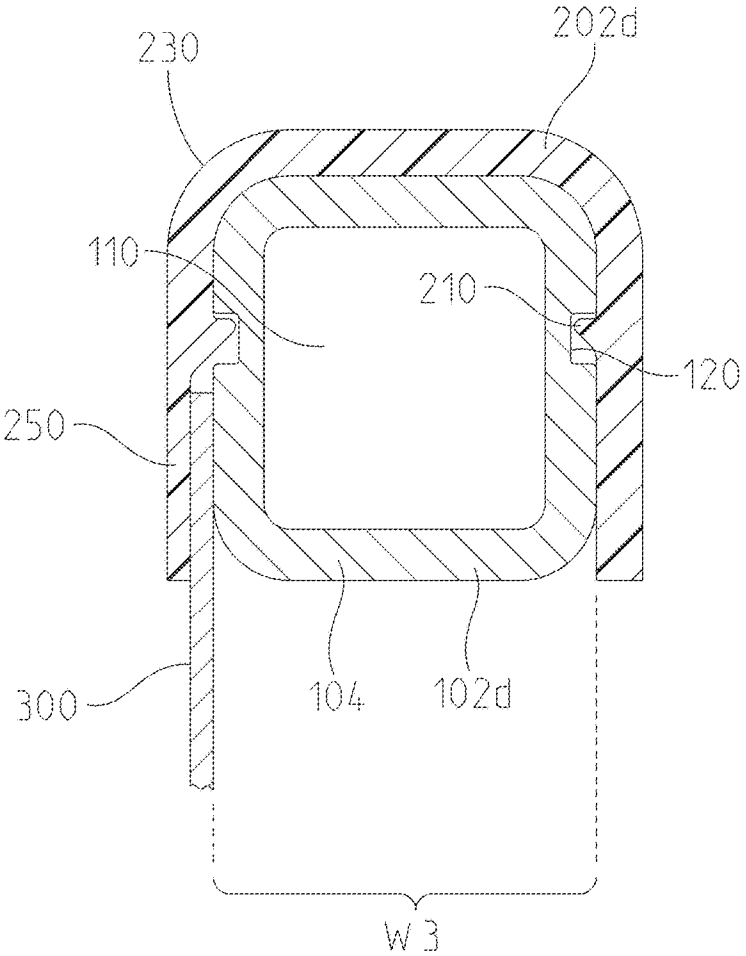
FIG. 5 illustrates a sectional view of still another upper rail and associated rail cap.

Referring now to FIGS. 5-6, the interactive members 210 of rail coupler 200 may only comprise exterior protrusions as the cap coupling features, and rail 102*d* accordingly only comprises exterior coupling features 120 as rail coupling features, as shown in the exemplary cap 202*d*. In the illustrated embodiment, interactive members 210 are at least partially curved to assist in positioning the interactive members 210 within exterior coupling features 120. In such an embodiment, the cap 202*d* may be flexed/deformed to stretch around the rail 102*d* in order to couple the cap 202*d* to the rail 102. Once coupled to the rail 102*d*, cap 202*d* may be removed by flexing the cap 202*d* to a point at which an end of interactive members 210 exit the exterior coupling features 120. In this way, the cap 202*d* is retained on rail 102*d* until an outward force is applied. As shown in FIG. 5, the entire cap 202*d* may be shaped such that the ends of cap 202*d* angle inward toward one another. As illustrated, the cap 202*d* comprises a first width W1 and a second width W2, and the rail 102*d* comprises a third width W3 wherein W1 and W3 are greater than W2. W3 may be less than or equal to W1. Such a configuration allows for the resiliency of the material within cap 202*d* to cause the interface portions 250 to press against the skin 300 and rail 102. FIG. 4 illustrates only one skin 300 coupled to rail 102, but in other embodiments another skin 300 may be located on the opposing side of rail 102 to form a double walled system. The skin 300 on the opposing side may be coupled to rail 102 with any combination of interactive members 210 and interface portions 250.

Figure 8:
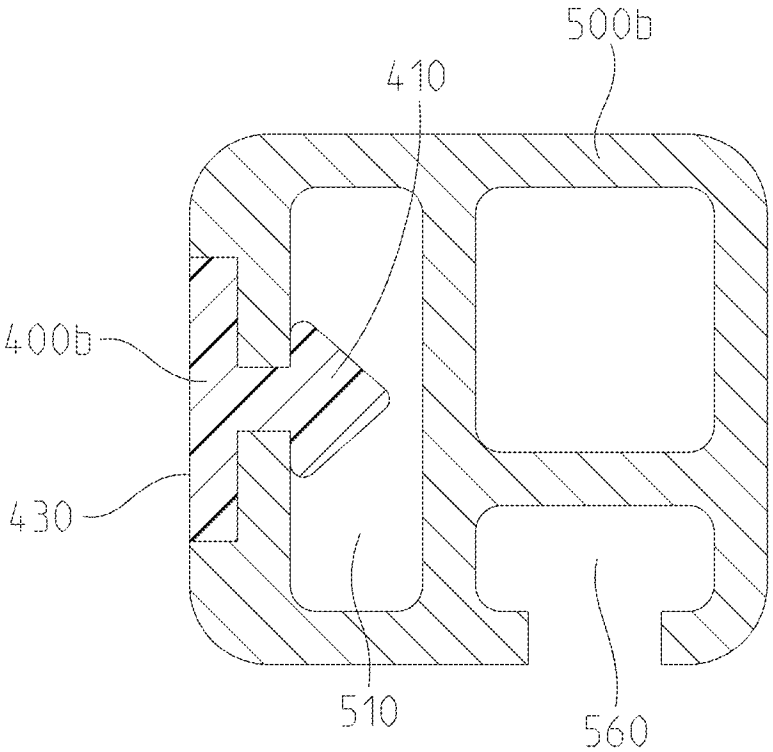
FIG. 8 illustrates a sectional view of another exemplary rail and another rail attachment.
Figure 7:
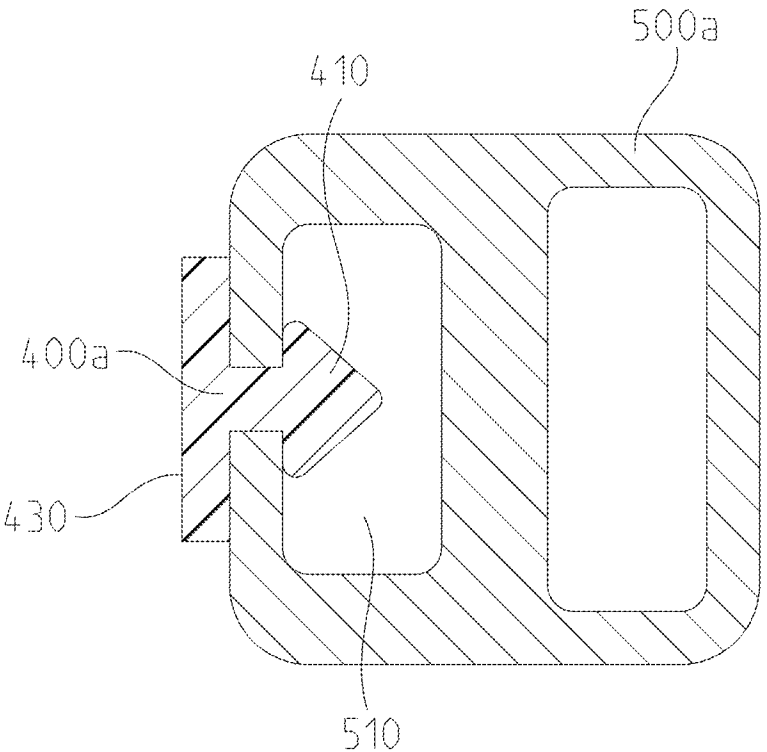
FIG. 7 illustrates a sectional view of an exemplary rail and rail attachment.

Referring to FIGS. 7-8, sectional views of support rails 500 are shown. As mentioned previously, the cross sections and features shown in FIGS. 7-8 may also be used for rails 102, and the sections shown in FIGS. 2-5 may be used for support rails 500. Support rails 500 may be positioned at various points along rail system 100 to support rails 102, and any other rails or features within rail system 100. Support rails 500 may be made from similar or identical materials and methods as rails 102. In the illustrated embodiments, support rails 500 may be configured to accept rail attachments 400 or any rail coupler 200. Similar to interactive members 210, rail attachments 400 may couple to support rails 500 by inserting an interactive member 410 into a support rail interior 510. Furthermore, as was the case with cap and rail coupling features, the rail attachment 400 may be coupled to the support rail 500 through any appropriate coupling mechanisms. Rail attachment 400 may also comprise an exterior surface 430, which may comprise various colors, accents, paint, coatings, textures, or other external features. Furthermore, rail attachment 400 may be a bumper or a rubber insert. As exemplified in the figures, rail attachment 400*a* may extend beyond the surface of support rail 500*a* (FIG. 6), may be flush with the surface of support rail 500*b* as exemplified in rail attachment 400*b* (FIG. 7), or may be recessed relative to the surface of the support rail 500. It should be recognized that rails 102 may comprise similar attachment features/rail connectors to support rails 500 in order to attach additional attachments to rails 102. For example, support rail 500*b* comprises a support rail coupling feature 560 configured to couple with external attachments. Rail couplers 200 such as rail attachments 400 may be attached, detached, or otherwise moved relative to rails 102 such as support rails 500 without disassembling the rails 102 themselves or the rail system 100.

Figure 9:
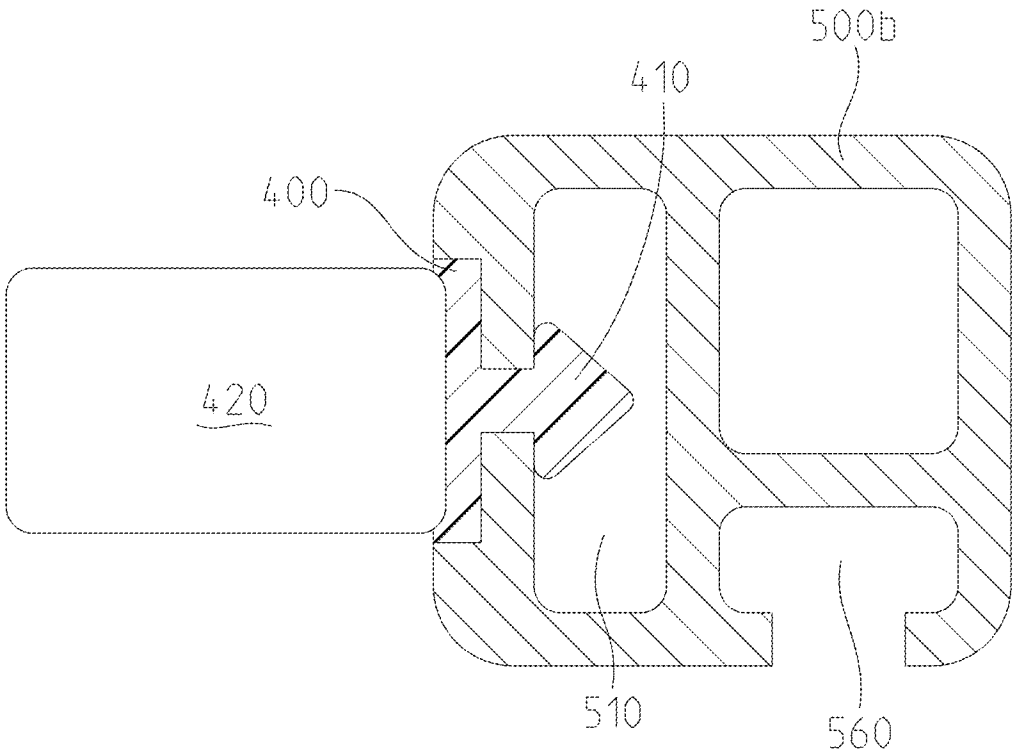
FIG. 9 illustrates a further sectional view of an exemplary rail and an attachment device.

Referring to FIG. 9, rail 102, in this embodiment illustrated as a support rail 500*b*, may be coupled with an attachment device 420. Attachment device 420 may be any device a user or manufacture may desire to attach to rail 102. Exemplary attachment devices 420 include position sensors (sonar, IR, etc.), motion sensors, light sensors, lighting systems, speakers, cameras, mirrors, cup holders, fishing rod holders, coolers, ornamental decorations, recreational devices (e.g. a basketball hoop), extendable tables/countertops, or any other suitable attachment device. In the illustrated embodiment, attachment device 420 is coupled to the rail 500*b* through rail attachment 400 and interactive member 410. In such an embodiment, the attachment device 420 may be configured to slide along an axis parallel to the rail 102 to which it is attached. For example, an attachment device 420 coupled to a top rail 104, may be configured to slide generally horizontally along the top rail 104, but may be restricted from moving vertically relative to top rail 104. In yet other embodiments, attachment device 420 may be locked into a single position. In still yet other embodiments, attachment device 420 may be configured to couple to any rail 102 through any of the coupling devices disclosed herein. Attachment device 420 may couple to a rail 102 through a coupling mechanism integral to the attachment device 420, or through a rail coupler 200. In embodiments, attachment device 420 may be a "LOCK-N-RIDE" coupler to attach an accessory such as position sensors (sonar, IR, etc.), motion sensors, light sensors, lighting systems, speakers, cameras, mirrors, cup holders, fishing rod holders, coolers, ornamental decorations, recreational devices (e.g. a basketball hoop), extendable tables/countertops to rail system 100. Additional details regarding the "LOCK-N-RIDE" coupler are found in U.S. Pat. No. 7,222,582, the disclosure of which is incorporated herein by reference. Rail system 100 would include opening sized and shaped to cooperate with the "LOCK-N-RIDE" coupler.

Figure 10:
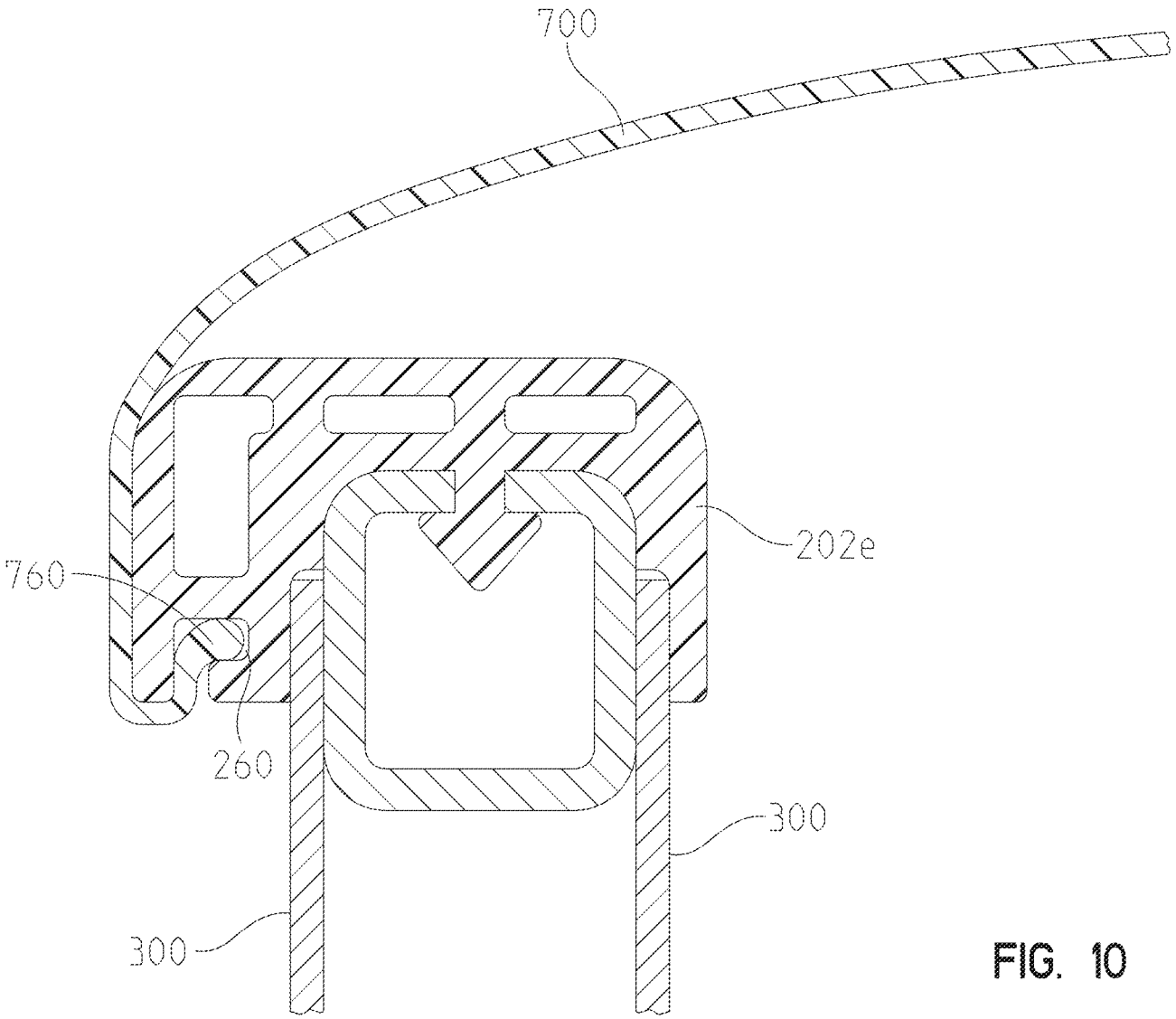
FIG. 10 illustrates a further still rail cap securing an outer skin and an inner skin to an upper rail and including an attachment feature securing an accessory, a cover to the enclosure.

Referring to FIG. 10, cap 202*e* may also comprise attachment features. In the illustrated embodiment, rail cap 202*e* comprises a cap attachment feature 260 that is configured to couple with an attachment feature 760 on a cover 700 for boat 10. Cover 700 may couple to rail 102 through cap 202*e* and may be used to provide shade or other forms of cover on boat 10. Cap attachment feature 260 may also be configured to couple with other attachments such as bumpers, facades, colored accents, lighting, etc.

Figure 11:
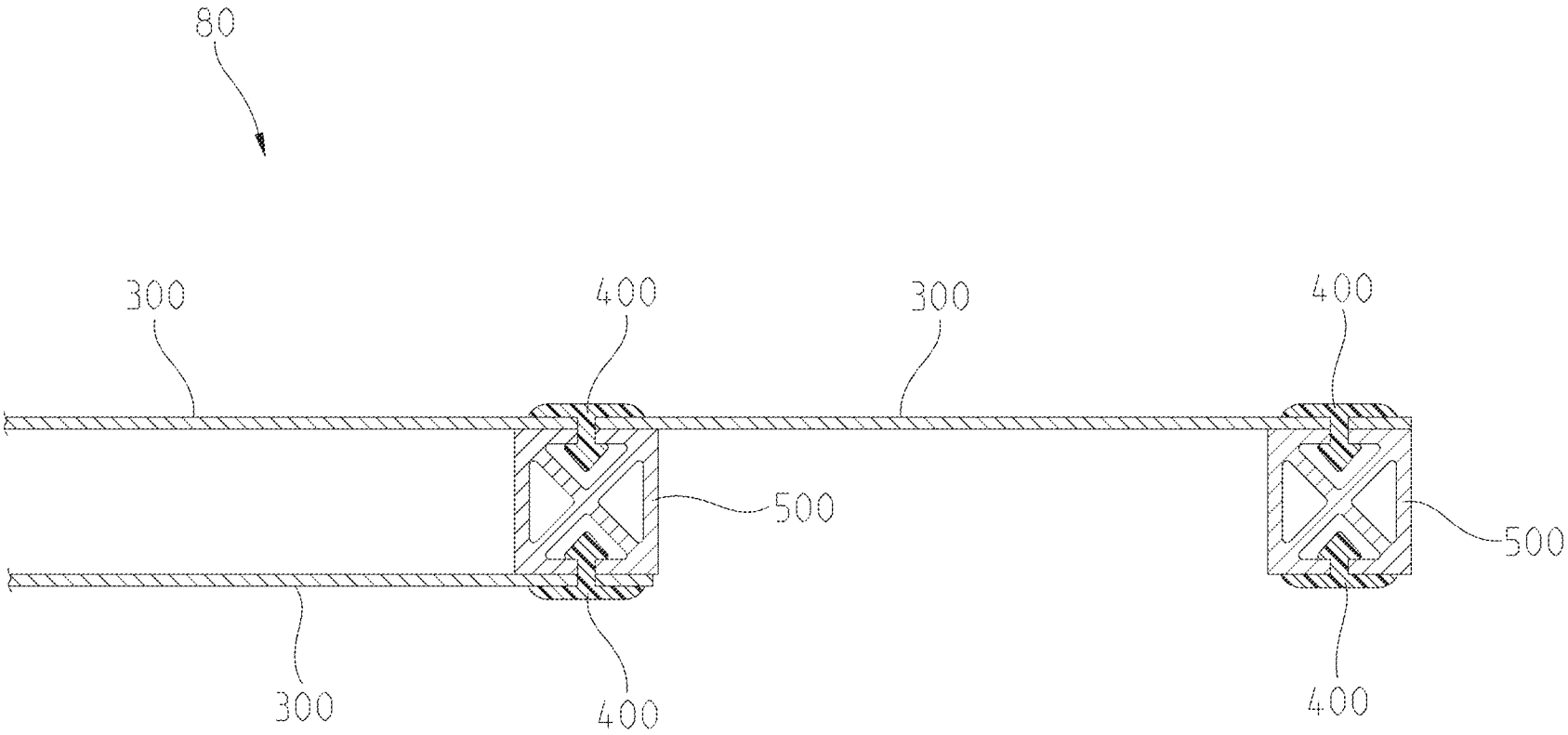
FIG. 11 illustrates a sectional view along a portion of line L1 or L2 in FIG. 1.

Referring to FIG. 11, a cross-sectional view of an exemplary version of rail system 100 is shown. In an illustrated embodiment, the cross-sectional view of the rail system 100 may be taken through one of lines L1 or L2 as seen in FIG. 1. As shown, the rail system 100 may comprise an exterior and an interior skin 300 with each skin coupled to an opposing side of support rails 500, or may comprise only a single skin 300. The interior and exterior skins 300 may be composed of different materials, and may have different features such as paints, coatings, textures, shapes, and corrugations. In sections where there is no skin 300 attached to support rails 500, rail couplers 200 such as rail attachments 400 (e.g. rubber stoppers/bumpers) may be attached. Rail attachments 400 may also be included between multiple skins 300 or over a portion of one skin 300. Furthermore, fasteners such as rivets or staples may be used to secure skins 300 to support rails 500.

Figure 12:
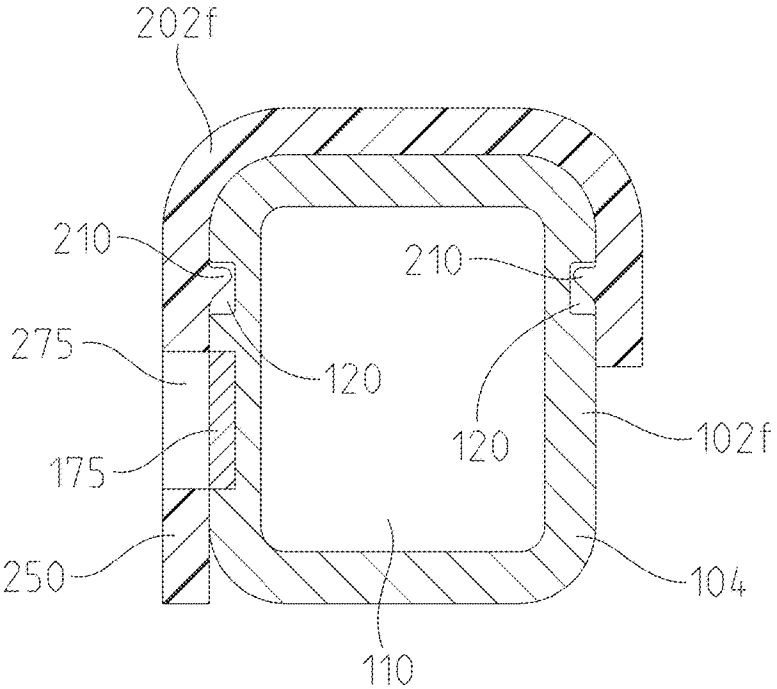
FIG. 12 illustrates a sectional view of another exemplary rail, an internal light, and another rail attachment.

Referring now to FIG. 12, yet another embodiment of a rail coupler 200 and rail 102 is illustrated. As illustrated, the rail coupler 200 in FIG. 11 is rail cap 202*f*, which is similar to rail cap 202*d*, but additionally comprises a transparent or translucent portion 275 between interface portion 250 and interactive member 210. The rail 102*f* includes a recess in which an illumination source 175 is received. The illumination source 175 is positioned generally next to transparent portion 275 of rail cap 202*d* and is configured to shine through transparent portion 275. In other embodiments, the illumination source 175 may be positioned on the bottom of a rail 102, or may be otherwise angled downward to provide illumination in a downward direction (e.g. courtesy lights) instead of/in addition to illumination in an outward direction. In such embodiments, the rail cap 202 may extend around the bottom of the rail 102 to secure the illumination source 175 to the rail 102, and the transparent portion 275 may be positioned on the bottom face of the rail cap 202. Additionally, the cap 202 may not extend around the bottom of the rail 102, and the illumination source 175 may be otherwise secured to the rail 102, such that the illumination source 175 may shine without passing through a transparent portion 275. The illumination source 175 and transparent portion 275 may extend along the entirety of rail 102*f* and cap 202*f* respectively, or they may be positioned at discrete points along rail 102*f* and cap 202*f*. In an exemplary embodiment, transparent portion 275 is a generally clear or transparent material within cap 202*f*, and the illumination source 175 is an LED strip coupled to the rail 102*f* In other embodiments, transparent portion 275 may be an additional element such as glass, an additional transparent polymer, or another form of window that is coupled to cap 202*f* Furthermore, transparent portion 275 may extend throughout any portion of the cap 202*f* including the entirety of cap 202*f*. Such an embodiment would allow a user to see other portions the rail 102*f* including other features on the surface of rail 102*f* beneath the cap 202*f*.

In yet other embodiments, transparent portion 275 may provide visible access to colored portions or accents of rail 102*f* instead of an illumination source 175. The illumination source 175 may be any device configured to emit light, such as lightbulbs or other phosphorescent, fluorescent, or luminescent materials. Furthermore, illumination source 175 may be movable relative to the rail 102*f* such that the illumination source 175 may be replaced or removed. Illumination source 175 may also be programmable to shine with different colors, as is known in the art. Illumination source 175 may be coupled to rail 102*f* through adhesives, or by the cap 202*f*. Interior 110 of rail 102*f* may comprise wires, power sources, or other electronic components to electrically couple to illumination source 175. In embodiments, transparent portion 275 is coextruded with the remainder of cap 202*f*.

Figure 13:
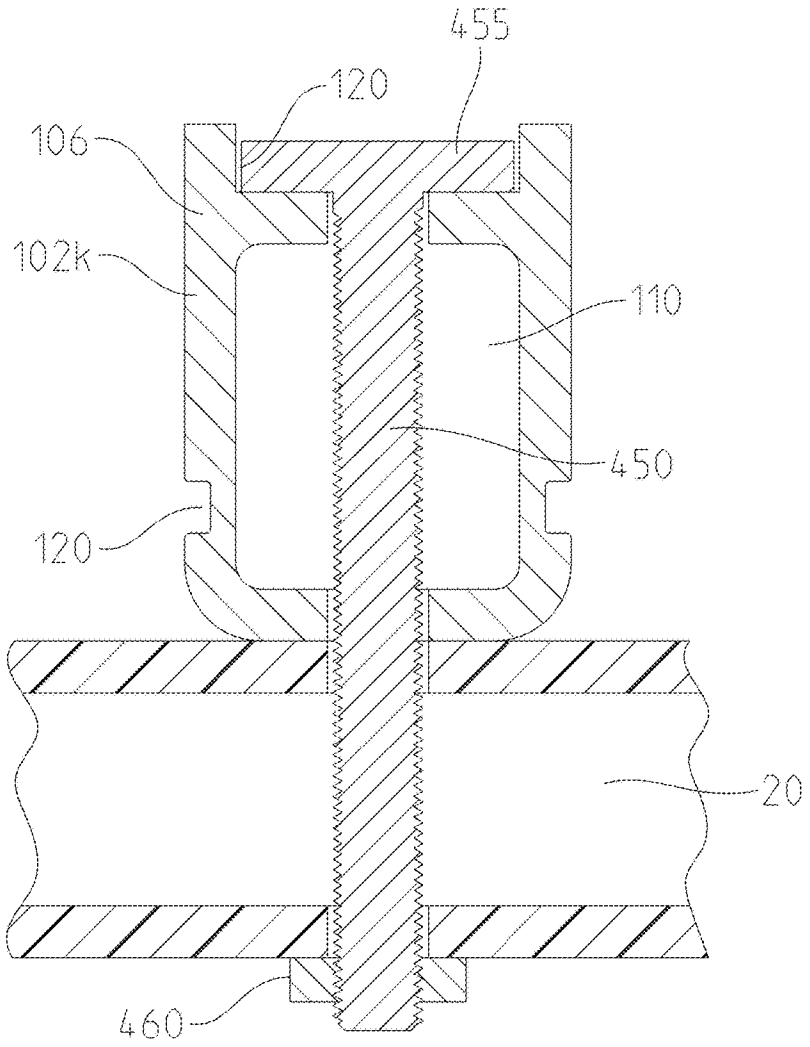
FIG. 13 illustrates a sectional view of a lower rail and a rail fastener.

Referring to FIG. 13, another embodiment of a lower rail 106 is disclosed. Rail 102*k* is configured to be coupled to the deck 20 of the boat 10 through fastener 450. In the illustrated embodiment, fastener 450 is a screw with a head 455, the head 455 configured to interface with an exterior coupling feature 120 of the rail 102*k*. The fastener 450 extends from the head 455 through the interior 110 of rail 102*k* and into deck 20. The fastener 450 may be coupled to the deck 20 of the boat through a nut and washer 460. In an exemplary embodiment, a number of holes are drilled into the deck 20, a rail coupler 200 and a lower rail 106 are positioned along the holes, and fasteners 450 are then used to couple the lower rail 106 and coupler 200 to the deck 20 through the holes. Rail 102*k* also comprises additional exterior coupling features 120 to couple with rail couplers 200. In other embodiments, fastener 450 may be a rivet, bolt, nail, staple, or other mechanism configured to couple a rail 102 to the boat 10.

Figure 14:
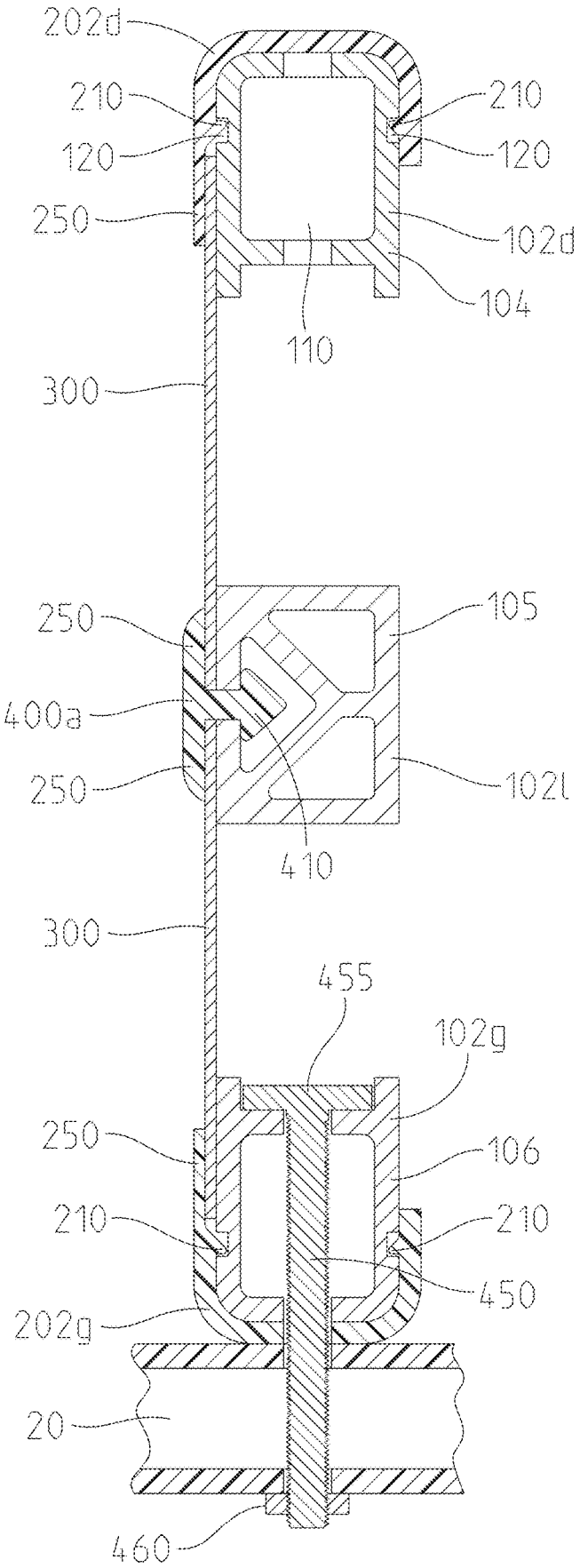
FIG. 14 illustrates a sectional view of along a portion of line L1 in FIG. 1 for a system with a middle rail between an upper rail and a lower rail.
Figure 15:
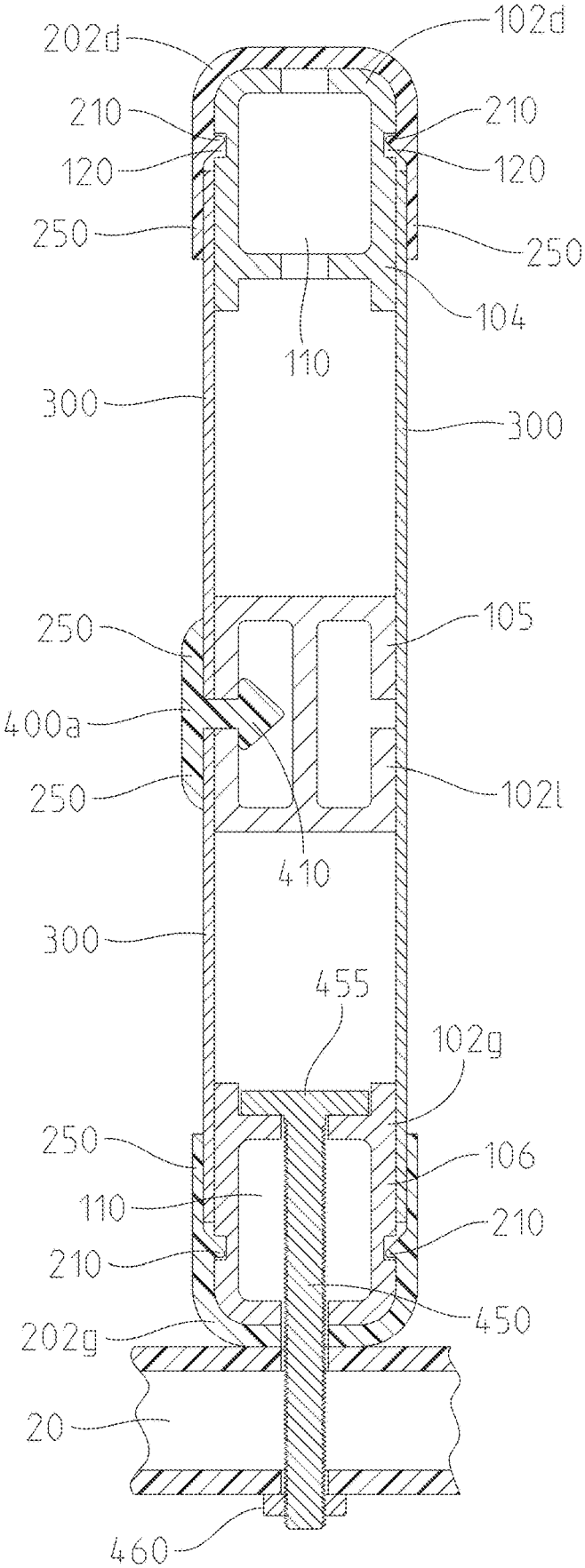
FIG. 15 illustrates the sectional view of FIG. 13 with a double skin system.

Referring now to FIGS. 14-15, exemplary sectional views of an enclosure system 80 are shown, comprising an upper rail 104, a middle rail 105, and a lower rail 106. In the illustrated embodiment, skins 300 extend between the upper rail 104 and the middle rail 105, as well as between the middle rail 105 and the lower rail 106. Any embodiments of rails 102 may be used for the upper rail 104, middle rail 105, and lower rail 106. In the illustrated embodiment, lower rail 106 is coupled to the deck 20 through fastener 450. Furthermore, lower rail 106 is illustrated as rail 102*g* configured to couple with cap 202*g*. Cap 202*g* may be coupled to rail 102*g* before the rail 102*g* is coupled to the deck 20 through fastener 450, and fastener 450 may extend through cap 202*g*. Cap 202*g* may be configured similarly to cap 202*d*, but with an additional opening to accommodate passage of fastener 450 through the cap 202*g*. The skin 300 may be coupled to the lower rail 106 by bending the interface portion 250 of cap 202*g* away from rail 102*g*. Furthermore, lower rail 106 may be coupled to deck 20 before or after the skin 300 is coupled to lower rail 106.

FIG. 15 illustrates a similar embodiment to FIG. 13, but with an additional skin 300 positioned on the interior of enclosure system 80. As illustrated, skin 300 may extend across the entire height of the enclosure system 80 as a single piece, or may be composed of multiple pieces of skin 300. In the illustrated embodiment, the middle rail 105 is configured to receive rail attachments 400 on both sides of rail 102*l*. Accordingly, rail 102*l* may couple to zero, one, or two skins 300 through rail attachment 400.

Figure 17:
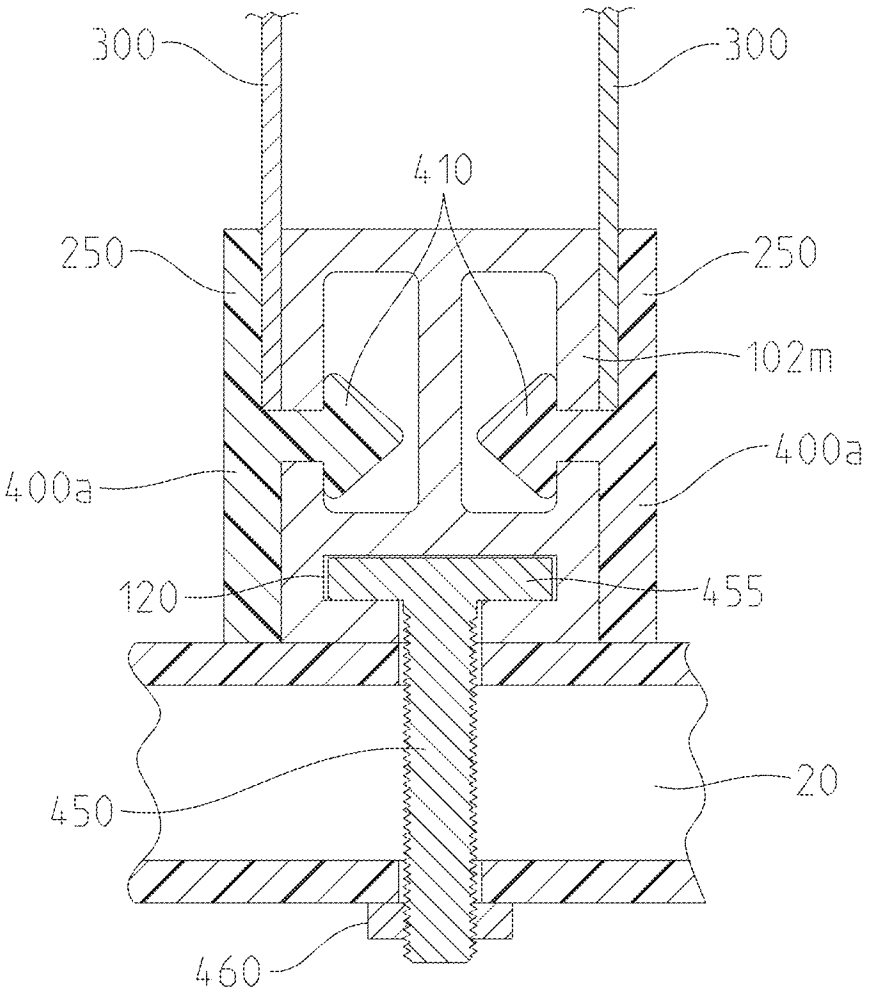
FIG. 17 illustrates a sectional view of yet another lower rail with two lower rail couplers and rail fastener.
Figure 16:
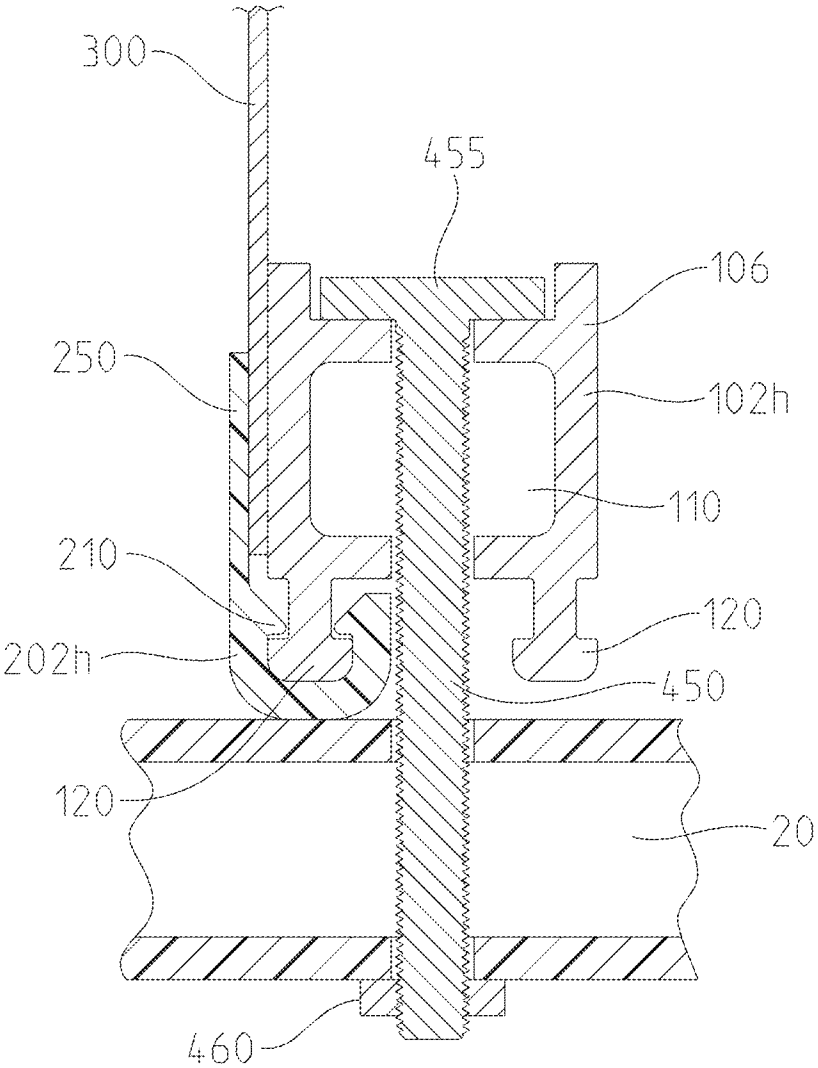
FIG. 16 illustrates a sectional view of another lower rail and a lower rail coupler and rail fastener.

FIGS. 16-17 illustrate various embodiments of lower rail 106. In FIG. 15, rail 102*h* comprises an external rail coupling feature 120, which is illustrated as a protrusion. In the exemplary embodiment, cap 202*h* comprises a number of interactive members 210 configured to interact with external rail coupling feature 120 to couple the cap 202*h* to the rail 102*h*. In this embodiment, the fastener 450 may not pass through the rail coupler 200 on the lower rail 106, and the rail coupler 200 could be coupled to the rail 102 after the rail 202*h* was fastened to the deck 20. The cap 202*h* may be coupled to rail 102*h* by bending or sliding a portion of cap 202*h* around the interactive member 210.

As shown in FIG. 17, lower rail 106 may also be configured in a similar fashion to rail 102*l*, and may be configured to couple with a number of rail attachments 400 through interactive members 210 configured to be protrusions. In this embodiment, rail 102*m* comprises an external coupling feature 120 configured to receive the head 455 of fastener 450. Similar to rail 102*h*, rail 102*m* allows for the attachment of rail couplers 200 to the rail 102 without interfering with the fastener 450. Rail attachments 400 may be coupled to rail 102*m* before or after the rail 102*m* has been coupled to the deck 20 through fastener 450. Fastener 450 may also be configured to extend through rail 102*m* in a manner similar to rails 102*h* and 102*k*.

Figure 19:
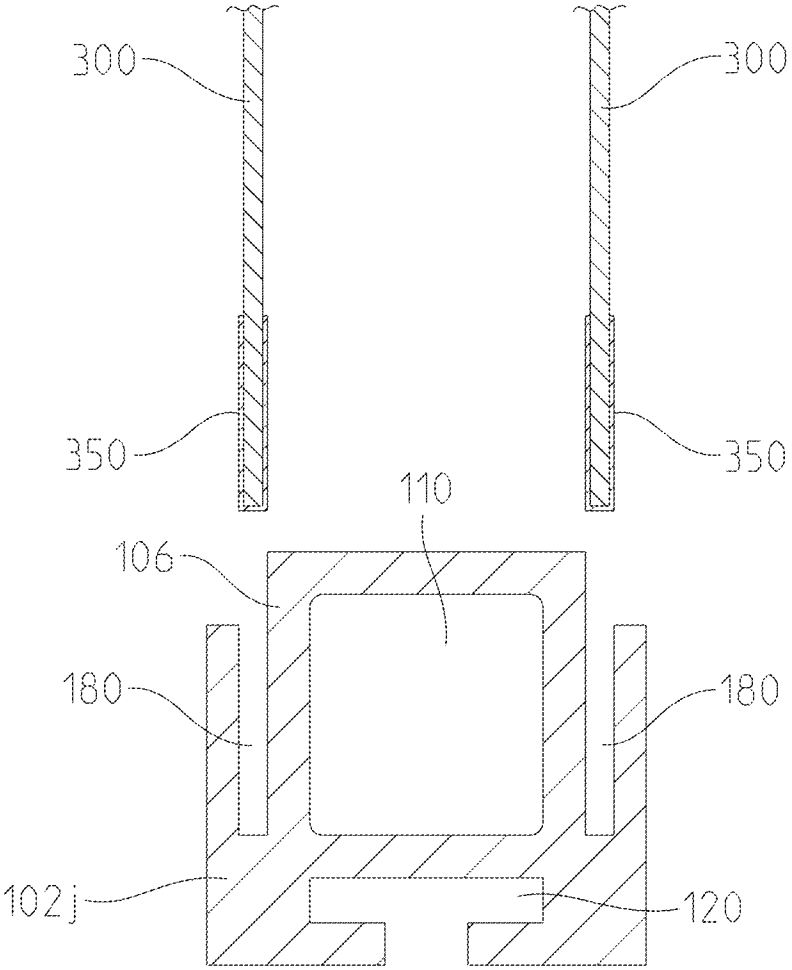
FIG. 19 illustrates a sectional view of still yet another exemplary rail and an outer skin.
Figure 18:
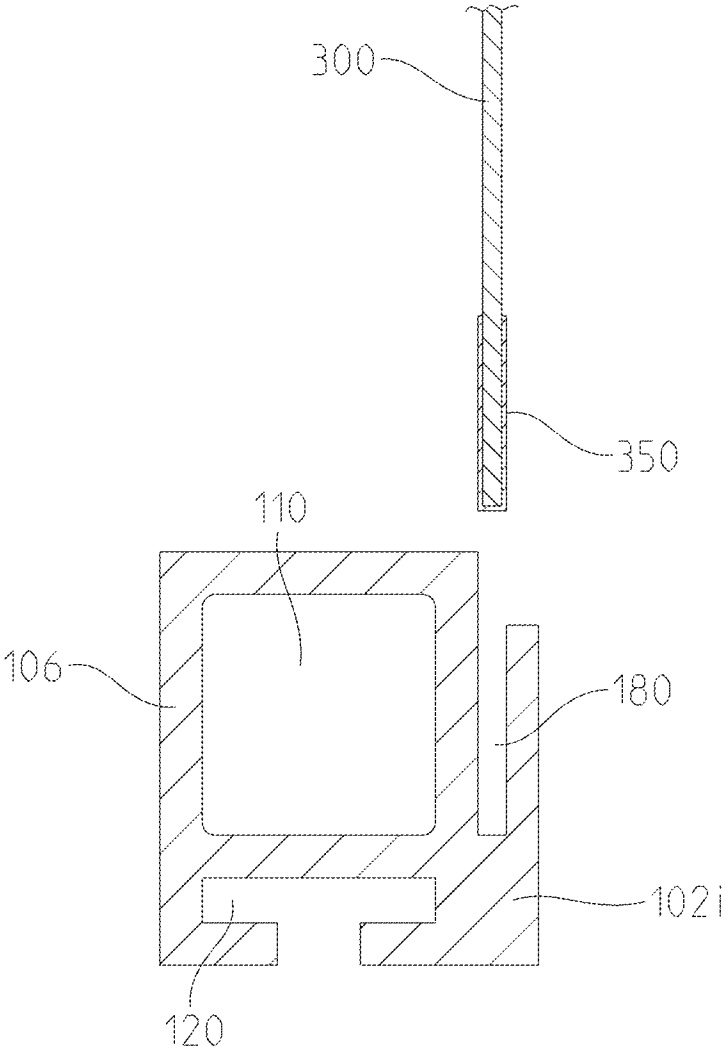
FIG. 18 illustrates a sectional view of yet another exemplary rail.

Referring to FIGS. 18-19, other embodiments of rails 102 are shown. Both rails 102*i* and 102*j* comprise an exterior pocket 180 configured to interface with the skin 300. Skin 300 may be inserted into exterior pocket 180 to couple the skin 300 to the rail 102 without a rail coupler 200. As shown in FIG. 18, skin 300 may comprise tape or an adhesive 350 to secure the skin 300 within the pocket 180 and prevent movement of skin 300 within pocket 180. The tape 350 may be single sided tape and may primarily provide additional thickness to the skin 300, or the tape 350 may be double sided tape to provide both thickness and adhesion. Both rails 102*i* and 102*j* comprise exterior coupling features 120 which may be configured to couple the rails 102*i* and 102*j* to the deck 20 through fastener 450. Rail couplers 200 may still be coupled to rails 102*i* and 102*j*. Different sides of rails 102 may comprise different features, such as external coupling features 120 or pockets 180 to couple with skin 300 or other attachments as needed. Accordingly, any of the features shown in any of the rails 102*a-m* may be used in combination with any other embodiment of rails 102*a-m*. In embodiments, rail couplers are also included to further secure skin(s) 300 to rails 102*i* and 102*j*, to provide protection to rails or skins, and/or to provide accent color or lighting features to boat 10.

Figure 20:
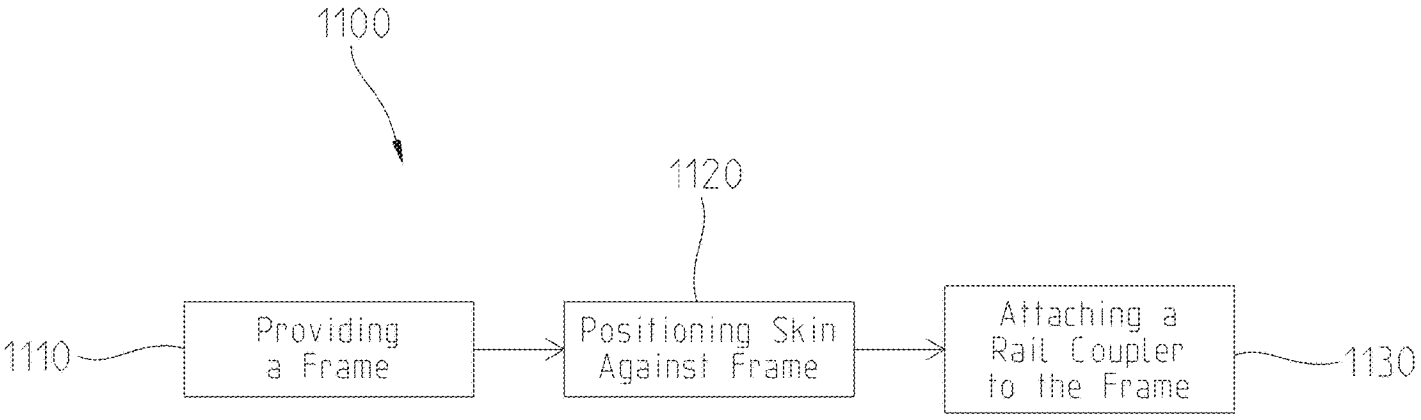
FIG. 20 illustrates a flow chart for method of attaching a skin to a frame.
Figure 21:
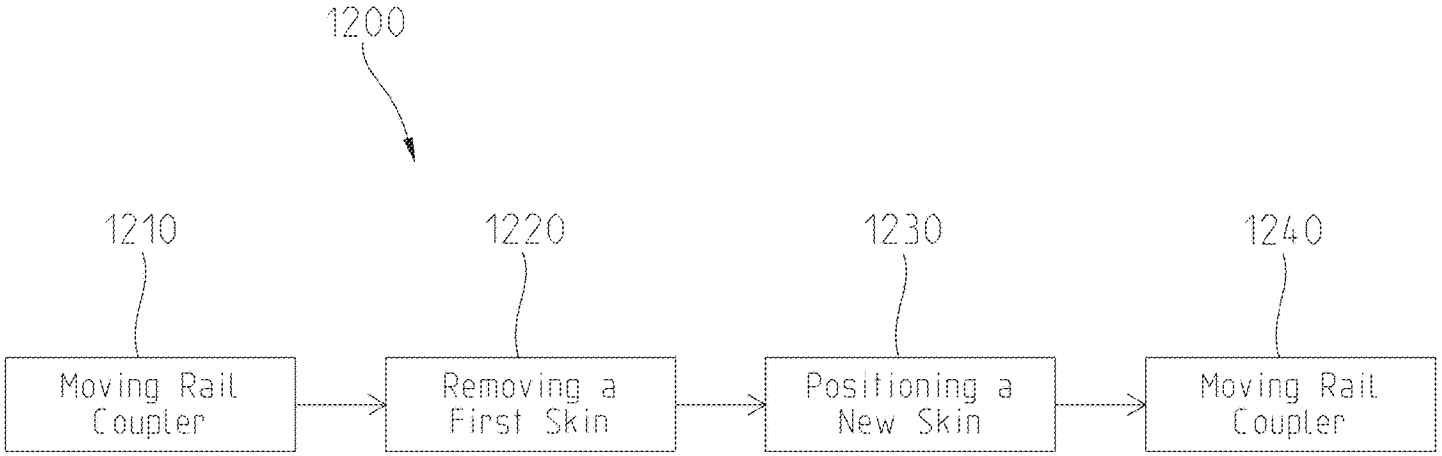
FIG. 21 illustrates a flow chart for a method of replacing a skin on a frame.
Figure 22:
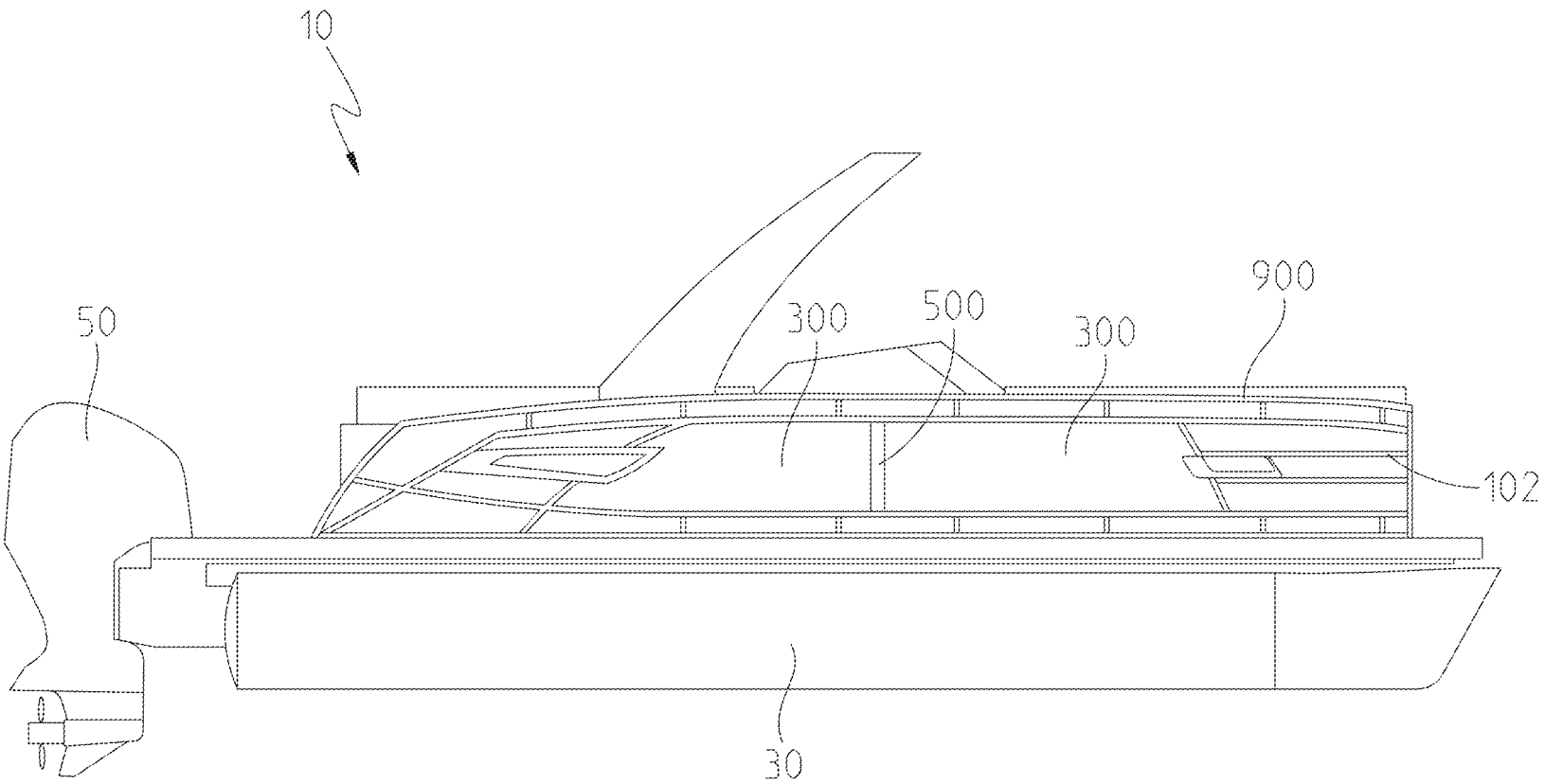
FIG. 22 illustrates a side view of a pontoon boat including a first exemplary enclosure system.
Figure 22A:
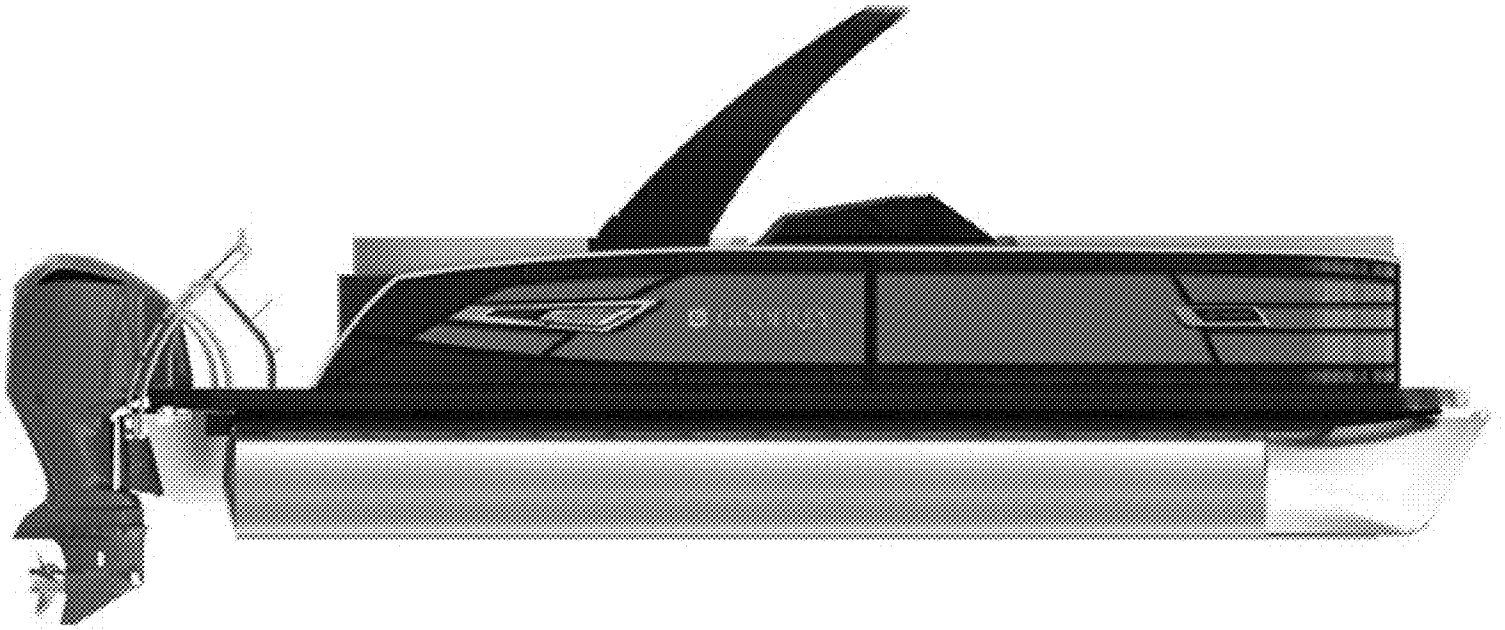
FIG. 22A is a color version of FIG. 22.
Figure 23:
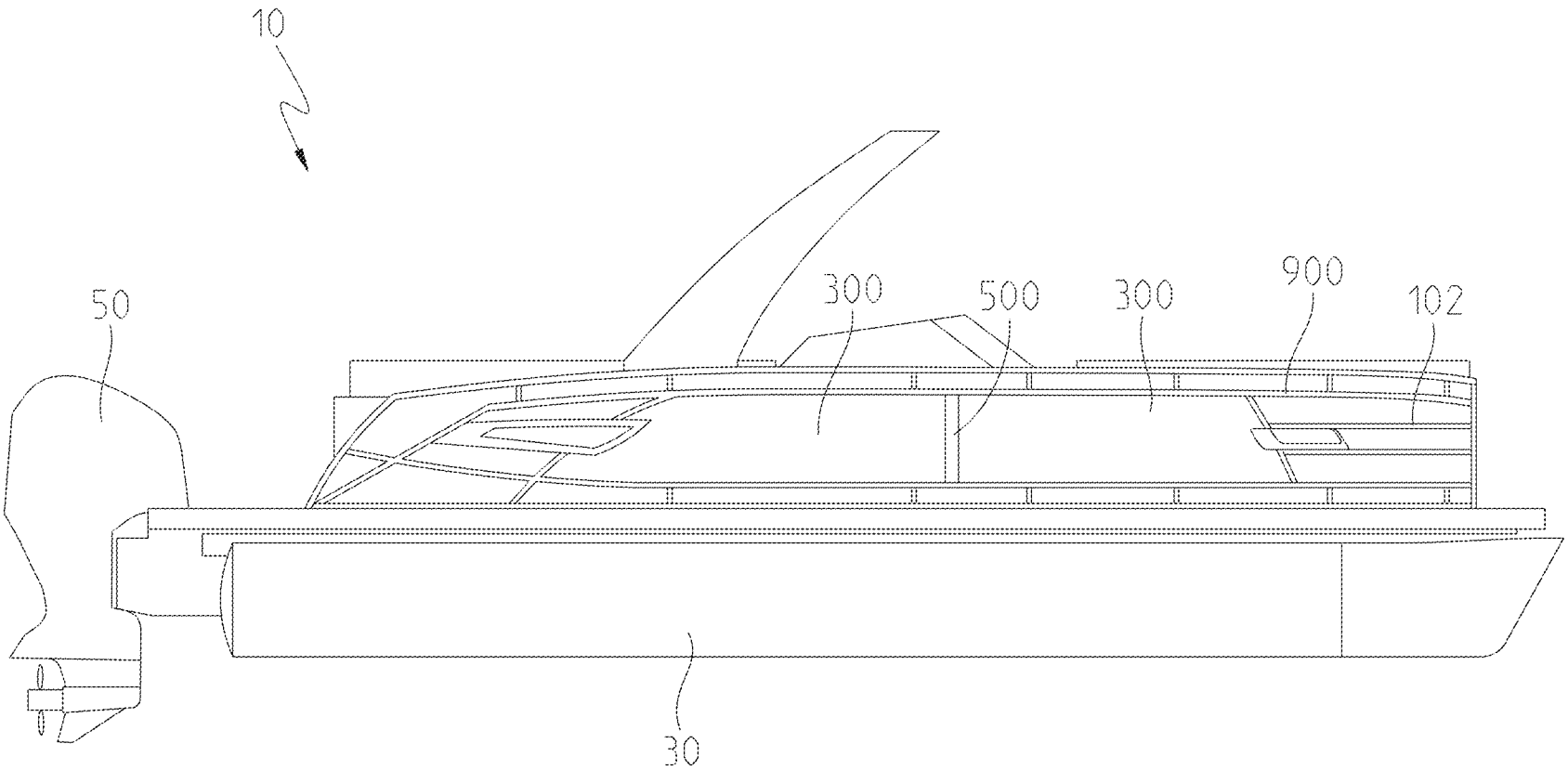
FIG. 23 illustrates a side view of a pontoon boat including a second exemplary enclosure system.
Figure 23A:
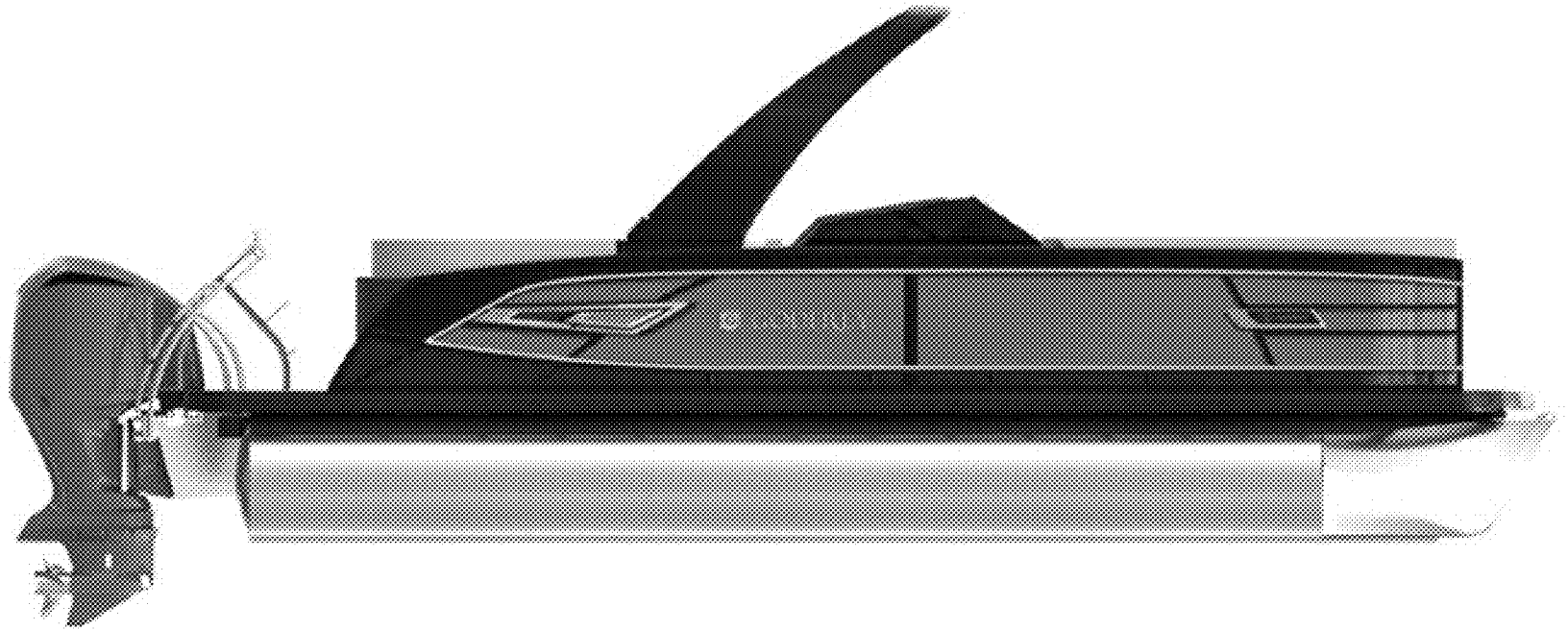
FIG. 23A is a color version of FIG. 23.
Figure 24:
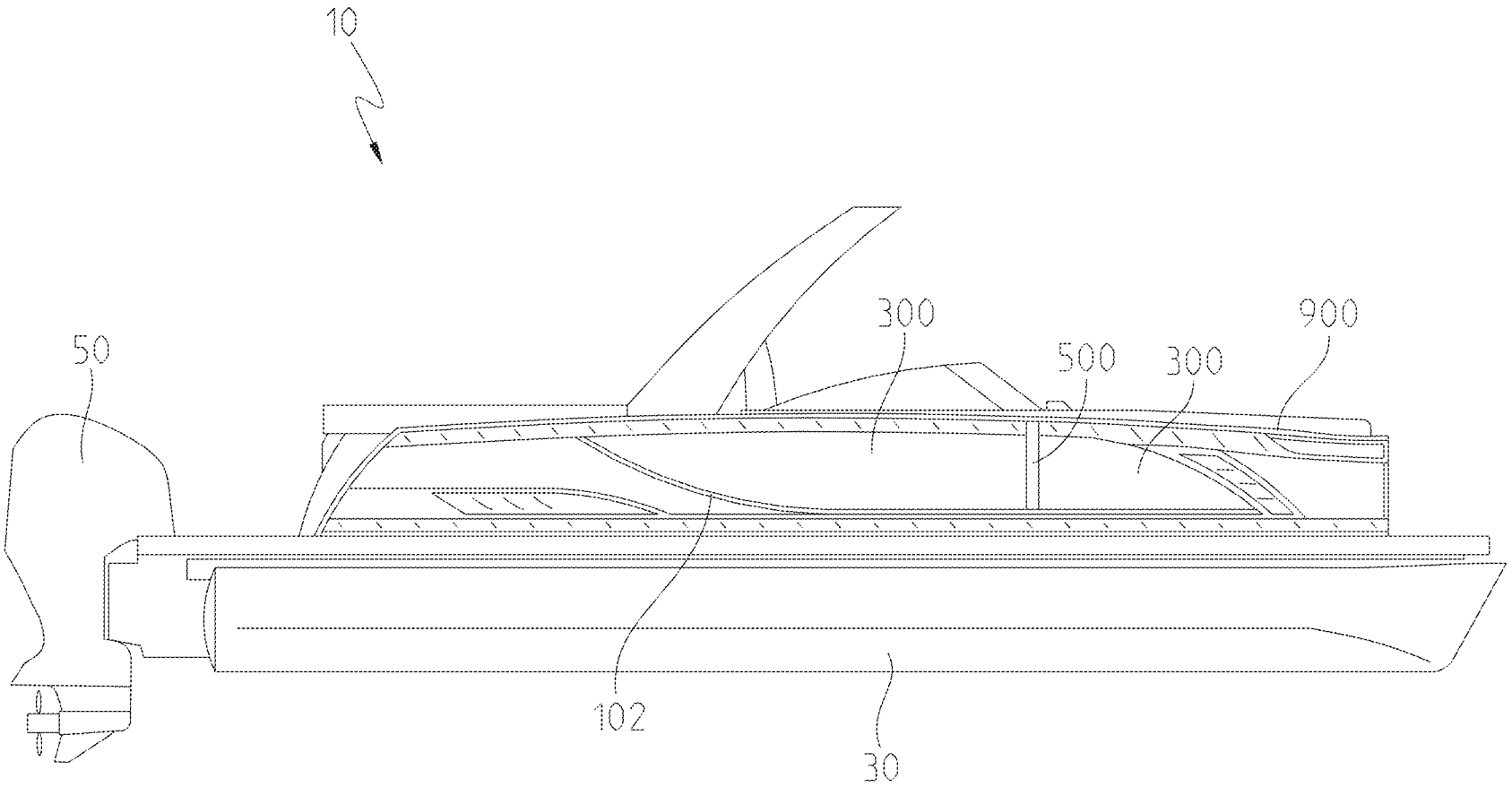
FIG. 24 illustrates a side view of a pontoon boat including a third exemplary enclosure system.
Figure 24A:
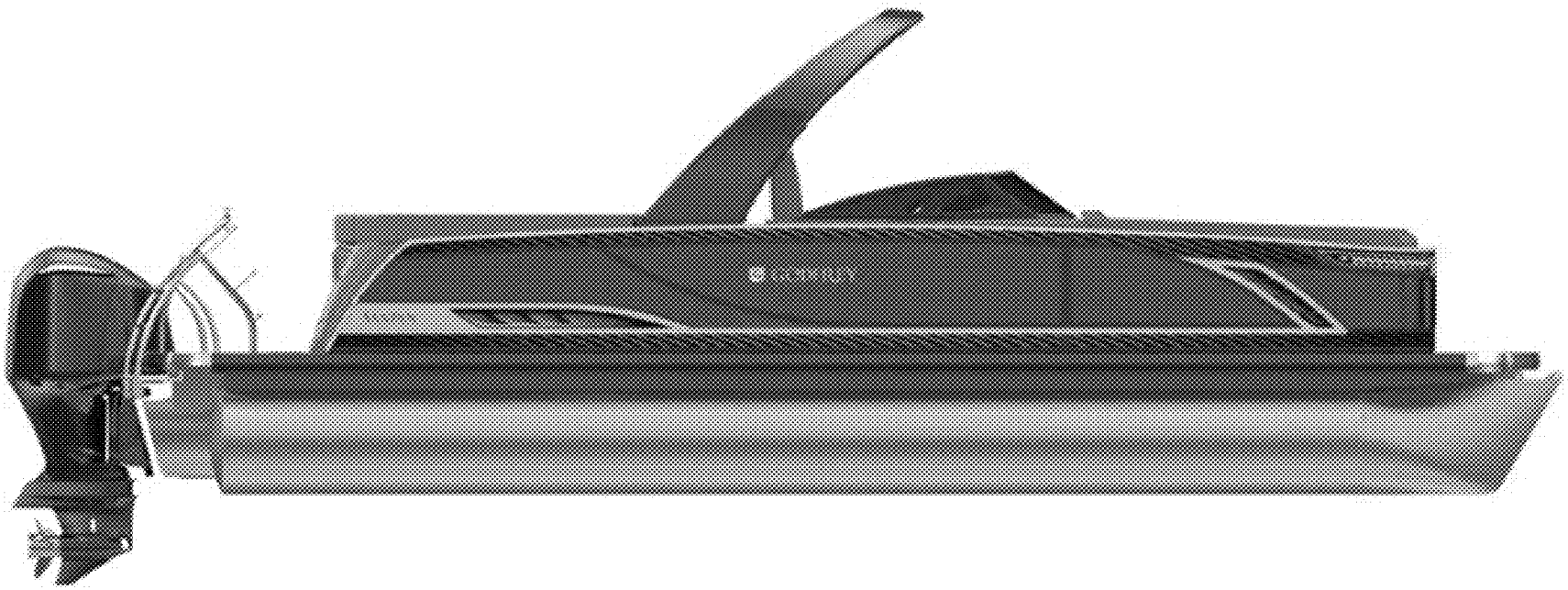
FIG. 24A is a color version of FIG. 24.
Figure 25:
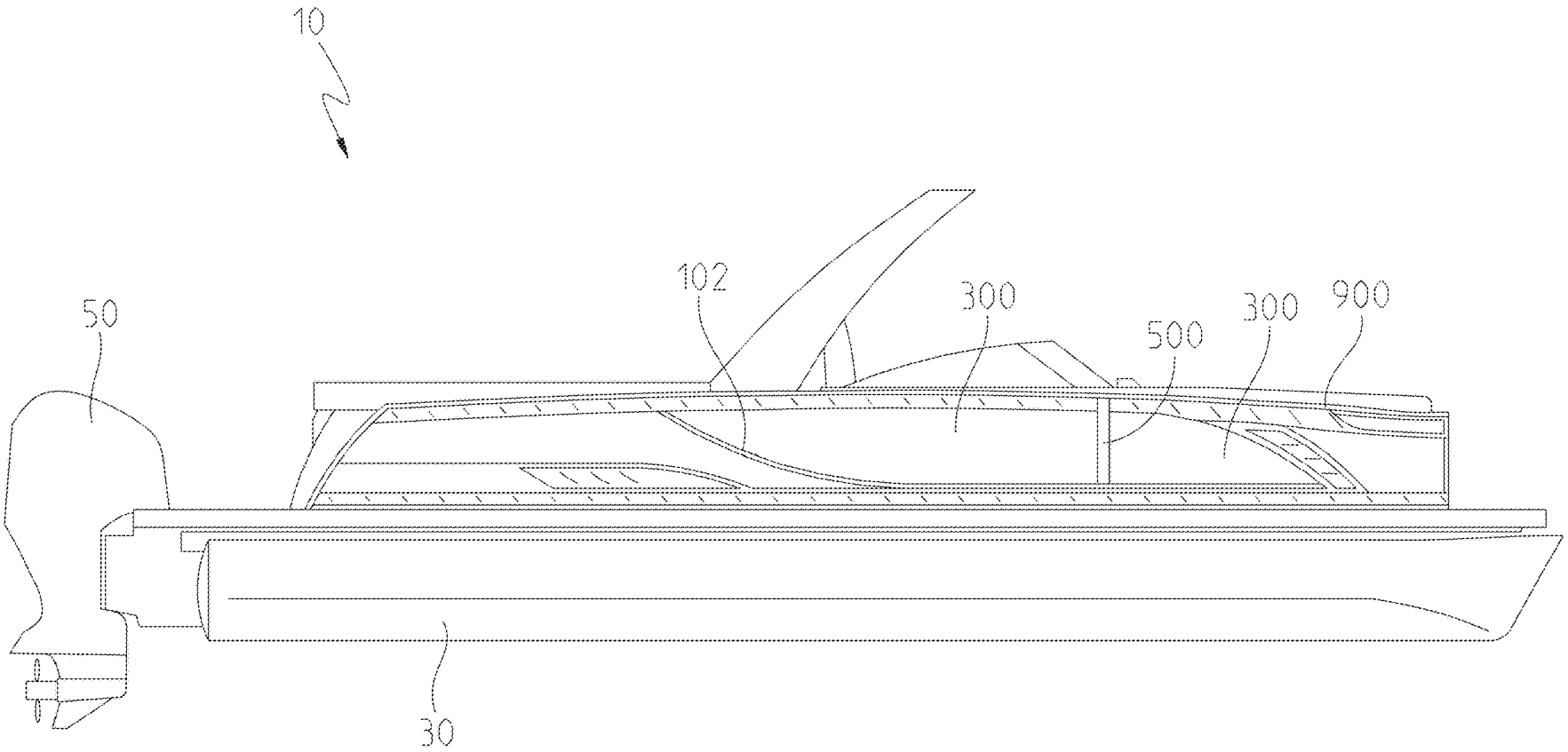
FIG. 25 illustrates a side view of a pontoon boat including a fourth exemplary enclosure system.
Figure 25A:
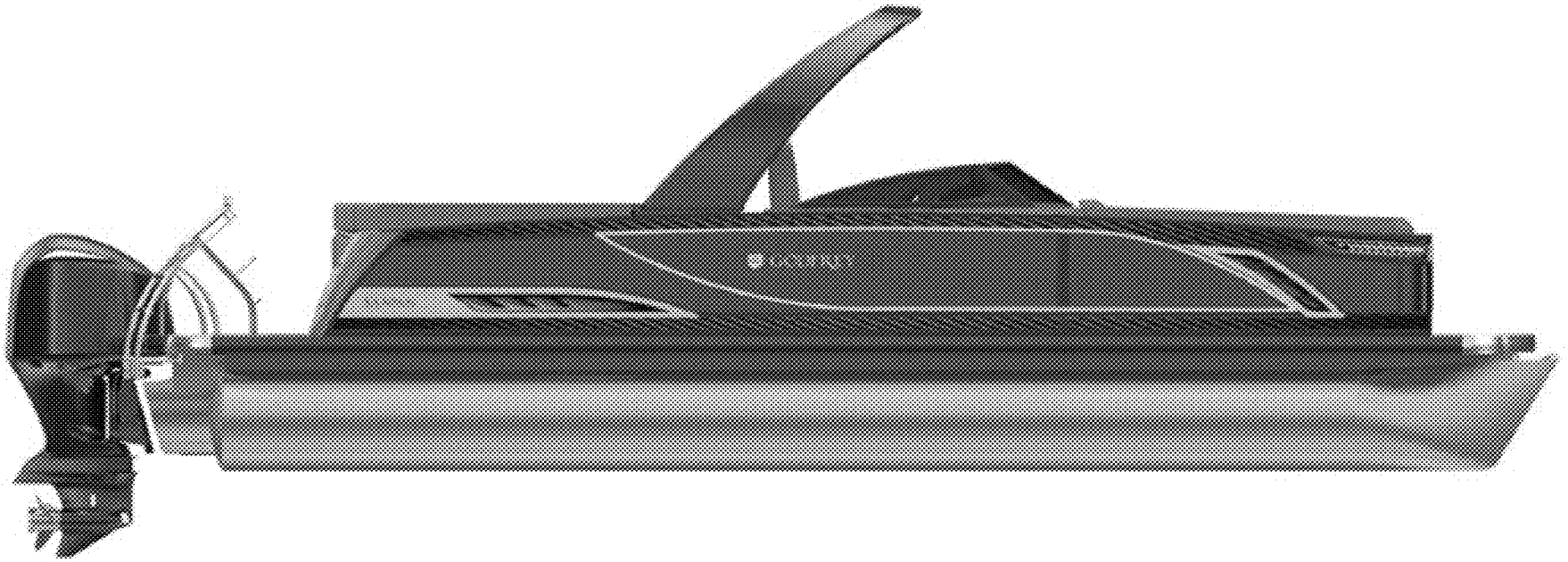
FIG. 25A is a color version of FIG. 25.

Referring to FIGS. 20-21, methods for adding a skin 300 to an enclosure system 80 of a boat 10 are shown. Addition method 1100 discloses the steps of providing a frame 1100, placing skin against the frame 1120, and then attaching a rail coupler to the frame 1130. The frame of step 1100 may be the rail system 100, otherwise referred to as a frame or skeletal system as disclosed above. The skin 300 is then positioned against the frame 100 along at least one side of the rails 102 of the frame 100, and then a rail coupler 200 is coupled/attached to the frame 100. When the rail coupler 200 is attached to the rails 102 of frame 100, the skin 300 is positioned between the rail coupler 200 and the rail 102 as discussed above and shown in the illustrated embodiments. In an exemplary embodiment, the rail coupler 200 is movable relative to the frame 100 and accordingly may be removed or attached to allow for the decoupling or coupling respectively of skin 300 to frame 100 without dismantling or moving the frame 100 relative to the boat 10.

A skin 300 may be removed and replaced through replacement method 1200. Replacement method 1200 comprises the steps of moving a rail coupler 1210, removing a first skin 1220, positioning a new skin 1230, and moving a rail coupler 1240. In this process, a rail coupler 200 is first moved relative to the frame 100 to allow for the removal of the skin 300. The moving of rail coupler 200 may comprise the steps of decoupling the rail coupler 200 from the rail 102, or otherwise bending or moving the rail coupler 200 away from the rail 102 to allow for the removal of skin 300. In some embodiments, the rail coupler 200 may even be broken, in which case a new rail coupler 200 would be used in step 1240. Once the first skin 300 is removed, a new skin 300 may be positioned along the frame 100, and a rail coupler 200 may be coupled to the frame 100 to couple the new skin 300 to the frame 100. The rail coupler 200 that is attached may be a new rail coupler 200 or the original rail coupler 200 from the first step 1210.

Referring to FIGS. 22-25, various embodiments of a pontoon boat 10 are disclosed with multiple different colored accent features. Since caps 202 and rail attachments 400 may be added or removed without dismantling the rail system 100, users have a large degree of customizability regarding the exterior of the boat 10. Colored accents 900 may be added onto the boat 10 as part of the cap 202, or as an attachment similar to rail attachments 400. In FIGS. 10 and 12, colored accent 900 extends generally along the top rail 102. In FIGS. 11 and 13, colored accent 900 extends generally along top rail 102 and bottom rail 103. Pontoon boat 10 also may comprise additional horizontal rails 102 which may be configured to receive attachments in a similar manner to rail attachments 400.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An enclosure system for a pontoon boat comprising:

a skeletal system comprising a plurality of rails and a skin that spans between the plurality of rails forming a wall around or within the pontoon boat, the plurality of rails including an upper rail and a lower rail, each of the upper rail and lower rail having a respective interior void and a respective first wall including an opening therethrough to the respective interior void;

the skin positioned against a first side of the upper rail and extending downward to a first side of the lower rail;

an upper rail coupler extending along the upper rail, the upper rail coupler including an upper rail coupler protrusion and an upper rail coupler interface portion unitary with the upper rail coupler protrusion, wherein the upper rail coupler protrusion is received through the opening in the first wall of the upper rail into the interior void of the upper rail to secure the upper rail coupler to the upper rail, the skin being captured between the upper rail coupler interface portion and the first side of the upper rail; and a lower rail coupler extending along the lower rail, the lower rail coupler including a lower rail coupler protrusion and a lower rail coupler interface portion unitary with the lower rail coupler protrusion, wherein the lower rail coupler protrusion is received through the opening in the first wall of the lower rail into the interior void of the lower rail to secure the lower rail coupler to the lower rail, the skin being captured between the lower rail interface portion and the first side of the lower rail thereby securing the skin to the skeletal system at the lower rail.

2. The enclosure system of claim 1, wherein each or the upper rail coupler and lower rail coupler are removably coupled to the skeletal frame.

3. The enclosure system of claim 1, wherein the respective protrusions of the upper rail coupler and lower rail coupler have respective flange-like portions for retaining the respective protrusions in the respective openings of the respective first walls.

4. The enclosure system of claim 1, wherein the first wall of the upper rail is a vertical wall and the upper rail further has a second wall that extends horizontally and faces upwardly and wherein the upper rail coupler interface portion extends along the upper rail first wall and the upper rail second wall.

5. The enclosure system of claim 1, wherein the first side of the upper rail is vertically oriented and a second side of the upper rail is horizontally oriented and is an upper wall and the upper rail coupler extends along the first side and the second side.

6. The enclosure system of claim 1, wherein the upper rail coupler is a rail cap, and wherein the rail cap overlaps a plurality of exterior sides of the upper rail including the upper rail first side.

7. The enclosure system of claim 6, wherein the rail cap includes an attachment feature to receive an accessory to couple the accessory to the upper rail.

8. The enclosure system of claim 1, wherein the rail cap is made of a flexible material.

9. An enclosure system for a pontoon boat comprising:

a skeletal system comprising a plurality of rails and a skin forming a wall around or within the pontoon boat, the skeletal system including an upper rail;

the skin positioned against a first side of the upper rail; and a rail coupler having a first leg extending along the first side of the upper rail, a second leg extending along a second side of the upper rail opposite the first side, and a connecting portion connecting the first leg and the second leg and extending along a third side of the upper rail, the third side being between the first side and the second side, the skin being captured between an interface portion of the rail coupler and the first side of the upper rail, the rail coupler coupling the skin to the skeletal system.

10. The enclosure system of claim 9, wherein the rail coupler is removably coupled to the skeletal frame.

11. The enclosure system of claim 9, wherein the rail coupler includes a first interactive member which cooperates with a first external coupling feature of the upper rail at the first side and a second interactive member which cooperates with a second external coupling feature of the upper rail at the second side.

12. The enclosure system of claim 11, wherein the first interactive member is a first protrusion and the first external coupling feature of the upper rail is a first recess to receive the first protrusion and the second interactive member is a second protrusion and the second external coupling feature of the upper rail is a second recess to receive the second protrusion, wherein first protrusion is removably insertable into the first recess and the second protrusion is removably insertable into the second recess.

13. The enclosure of claim 9, wherein the upper rail has a first width and the rail coupler includes a first leg and a second leg spaced apart from the first leg and a connecting portion, the first leg, the second leg, and the connecting portion defining a void wherein the upper rail is positioned, the first leg and the send leg having a separation prior to receiving the upper rail, the separation of the first leg and the second leg being less than the first width of the upper rail.

14. The enclosure system of claim 9, wherein the rail coupler is made of a flexible polymer material and the first leg, second leg, and connection portion are all unitary with one another.

15. A method for adding a skin onto a pontoon boat for forming a wall around or within the pontoon boat, the method comprising the steps of:

providing a skeletal frame including an upper rail supported by a deck of the pontoon boat;

placing the skin against an outer surface of the upper rail with the skin extending downwardly from the upper rail; and attaching a resilient polymer rail cap onto the rail such that the rail cap presses the skin against the rail, thereby securing the skin to the upper rail forming the wall of the pontoon boat.

16. A method for replacing a skin on a skeletal frame of a pontoon boat that forms a wall around or within the pontoon boat, the method comprising the steps of:

moving a rail cap relative to an upper rail of the skeletal frame of the pontoon boat from a first position to a second position, wherein in the first position the rail cap secures the skin relative to the upper rail of the skeletal frame by pressing the skin toward the rail, and wherein and in the second position the rail cap does not secure the skin relative to the upper rail;

removing the skin from a position against the upper rail;

positioning a new skin along the upper rail; and moving the rail cap back to the first position wherein the rail cap is pressing the new skin against the rail thereby securing the new skin relative to the upper rail of the skeletal frame.

17. The method of claim 16, wherein in the second position the rail cap is completely spaced apart from the upper rail of the skeletal frame.

18. A method for replacing a skin on a pontoon boat, the skin forming a wall of the pontoon boat, the method comprising the steps of:

removing a rail cap relative to an upper rail of a skeletal frame of the pontoon boat from a first attached position to a second removed position, wherein in the first position the rail cap holds and presses the skin onto and along the upper rail of the skeletal frame;

removing the skin from a position against the upper rail;

positioning a new skin along the upper rail of the skeletal frame; and positioning a new rail cap relative to the upper rail to hold the new skin relative to the upper rail of the skeletal frame.

19. An enclosure system for a pontoon boat comprising:

a frame coupled to a deck of the pontoon boat comprising a number of rails;

an illumination source coupled to at least one of the number of rails; and a rail coupler coupled to the at least one of the number of rails and extending over the illumination source, the rail coupler comprising a transparent portion configured to allow a light from the illumination source to pass through the rail coupler.

20. The enclosure system of claim 19, further comprising a skin positioned at least partially between the rail coupler and the at least one of the number of rails.

* * * * *